US007537300B2

(12) United States Patent
Hirota et al.

(10) Patent No.: US 7,537,300 B2
(45) Date of Patent: May 26, 2009

(54) INKJET PRINTER

(75) Inventors: Atsushi Hirota, Nagoya (JP); Ayumu Matsumoto, Kokubu (JP)

(73) Assignees: Brother Kogyo Kabushiki Kaisha, Nagoya-shi, Aichi (JP); Kyocera Corporation, Kyoto-shi, Kyoto (JP)

( * ) Notice: Subject to any disclaimer, the term of this patent is extended or adjusted under 35 U.S.C. 154(b) by 235 days.

(21) Appl. No.: 11/382,841

(22) Filed: May 11, 2006

(65) Prior Publication Data

US 2006/0256148 A1 Nov. 16, 2006

(30) Foreign Application Priority Data

May 13, 2005 (JP) ..... 2005-140842
Nov. 29, 2005 (JP) ..... 2005-343329

(51) Int. Cl.
*B41J 29/38* (2006.01)

(52) U.S. Cl. ..... 347/11; 347/10

(58) Field of Classification Search ..... 347/11
See application file for complete search history.

(56) References Cited

U.S. PATENT DOCUMENTS 5,291,248 A * 3/1994 Isobe ..... 399/4
6,109,736 A * 8/2000 Miyata et al. ..... 347/68
6,174,040 B1 * 1/2001 Hotomi ..... 347/20
6,431,674 B2 8/2002 Suzuki et al.
6,494,555 B1 * 12/2002 Ishikawa ..... 347/10
6,676,238 B2 * 1/2004 Fujimura et al. ..... 347/11
2004/0051763 A1 3/2004 Matsubara et al.
2006/0256163 A1 11/2006 Itsushi et al.
2006/0256164 A1 11/2006 Hirota et al.
2006/0284908 A1 12/2006 Iwao

FOREIGN PATENT DOCUMENTS

JP H6 328683 11/1994
JP 2004 128492 4/2004
JP 2004 160903 6/2004

* cited by examiner

*Primary Examiner*—Matthew Luu
*Assistant Examiner*—Brian J Goldberg
(74) *Attorney, Agent, or Firm*—Baker Botts, LLP

(57) ABSTRACT

An inkjet printer whose ink discharge characteristics will rarely change even when used for a long period of time is developed. The inkjet printer has a pressure chamber, a piezoelectric actuator forming a wall of the pressure chamber and a controller for applying voltage to the piezoelectric actuator. The controller applies a predetermined voltage in general, and the piezoelectric actuator is usually deformed to project toward the pressure chamber. Ink discharge signal comprises an advanced voltage change from the predetermined voltage to zero and a subsequent change from zero to the predetermined voltage. The characteristics of the piezoelectric actuator will change if the piezoelectric actuator is continuously deformed during ink non-discharge period. The controller applies an additional signal including an advanced change from the predetermined voltage to a lower voltage and a subsequent change from the lower voltage to the predetermined voltage. The piezoelectric actuator is periodically loosened from the deformed state during non-discharge period, and the change in the characteristics of the piezoelectric actuator over time can be reduced.

17 Claims, 13 Drawing Sheets

FIG. 13

| Tx:T0 | Evaluation Result |
|---|---|
| 1:8 | Good |
| 2:8 | Good |
| 3:8 | Good |
| 4:8 | Good |
| 5:8 | Not Good |
| 6:8 | Not Good |
| 7:8 | Not Good |

INKJET PRINTER

CROSS REFERENCE TO RELATED APPLICATIONS

This application claims priority to Japanese Patent Application No. 2005-140842 filed on May 13, 2005 and Japanese Patent Application No. 2005-343329 filed on Nov. 29, 2005, the contents of which are hereby incorporated by reference into the present application.

BACKGROUND OF THE INVENTION

1. Field of the Invention

The present invention relates to an inkjet printer.

2. Description of the Related Art

An inkjet printer having an inkjet head is known. An inkjet head is provided With a pressure chamber, a piezoelectric actuator sealing the pressure chamber, and a nozzle communicated with the pressure chamber. The pressure chamber is filled with ink when the inkjet printer is used, and the piezoelectric actuator applies pressure to the ink within the pressure chamber. When the ink within the pressure chamber is pushed by a deformation of the piezoelectric actuator, ink is discharged from the nozzle. In this way, the inkjet printer will print text and/or image on a printing medium.

A conventional inkjet printer is disclosed in Japanese Patent Application Publication No. 2004-128492.

The piezoelectric actuator is arranged so as to form at least a portion of a wall defining the corresponding pressure chamber and to seal the pressure chamber. Electrodes are arranged on both surfaces of a piezoelectric film of the piezoelectric actuator.

By applying voltage difference between the electrodes, the piezoelectric actuator deforms due to the piezoelectric effect. Because the piezoelectric actuator forms a portion of the wall defining the pressure chamber, the volume of the pressure chamber changes due to the deformation of the piezoelectric actuator. By deforming the piezoelectric actuator so that the volume of the pressure chamber becomes, smaller, pressure can be applied to the ink within the pressure chamber. By applying pressure to the ink within the pressure chamber, the ink will be discharged from the nozzle that communicates with the pressure chamber.

The so-called "fill before fire" method is often used in order to improve ink discharge efficiency by the piezoelectric actuator. In this method, the following operations are performed. According to "fill before fire" method, a predetermined voltage is applied to the piezoelectric actuator prior to ink discharge operation. Due to the predetermined voltage, the piezoelectric actuator is deformed so that the volume of the pressure chamber becomes smaller. When the ink is to be discharged, an ink discharge signal is applied to the piezoelectric actuator. The ink discharge signal is composed of a combination of an advanced voltage change and a subsequent voltage change. In the advanced voltage change, voltage applied to the piezoelectric actuator is changed from the predetermined voltage that has been applied to the piezoelectric actuator to zero voltage. Due to the advanced voltage change, the piezoelectric actuator is freed from the deformed shape, and the volume of the pressure chamber is increased. At the timing when the volume of the pressure chamber is increased, a negative pressure is generated within the pressure chamber. The generated pressure decrease develops a pressure wave within the pressure chamber. The developed pressure wave will propagate from the pressure chamber to the nozzle through an ink passage communicating the pressure chamber and the nozzle, and the pressure wave is reflected at the nozzle toward the pressure chamber. The reflected pressure wave will return to the pressure chamber. Due to reciprocation of the pressure wave, the pressure within the pressure chamber varies cyclically between a negative pressure and a positive pressure.

According to "fill before fire" method, the subsequent voltage change is applied to the piezoelectric actuator while the pressure wave continues. In the subsequent voltage change, voltage applied to the piezoelectric actuator is changed from zero voltage that has been applied to the piezoelectric actuator to the predetermined voltage. Due to the subsequent voltage change, the piezoelectric actuator is deformed again, and the volume of the pressure chamber is decreased. According to "fill before fire" method, the subsequent voltage change is applied when positive pressure is developed within the pressure chamber due to the pressure wave generated by the advanced voltage change. In this method, the deformation of the piezoelectric actuator to decrease the volume of the pressure chamber and to increase the pressure within the pressure chamber occurs at timing when the pressure within the pressure chamber is increased to the positive value due to the pressure wave. Therefore, a large positive pressure is developed within the pressure chamber by the subsequent voltage change, and ink is effectively discharged from the nozzle. High discharge efficiency may be obtained by "fill before fire" method. The time period from the advanced voltage change to the subsequent voltage change is critical to obtain high ink discharge efficiency.

The pressure wave generated by the advanced voltage change reciprocates a certain distance within the ink passage including an ink storage space, the pressure chamber and the nozzle. This distance is usually referred to acoustic length (AL). The pressure within the pressure chamber vibrates with a cycle time having a value that the acoustic length (AL) is divided by a propagating speed of the pressure wave. When the time period from the advanced voltage change to the subsequent voltage change is appropriate, and the subsequent voltage change is applied at timing when the pressure within the pressure chamber is increased to the positive value due to the pressure wave, high ink discharge efficiency can be obtained. When the time period from the advanced voltage change to the subsequent voltage change is inappropriate, and the subsequent voltage change is applied at timing when the pressure within the pressure chamber is decreased to the negative value due to the pressure wave, high ink discharge efficiency can not be obtained, or ink can not be discharged.

BRIEF SUMMARY OF THE INVENTION

With the "fill before fire" method, the predetermined voltage is continuously applied to the piezoelectric actuator other than the period while the applied voltage is changed to zero voltage. The period while the applied voltage is kept at the predetermined voltage is much longer than the period while the applied voltage is changed to zero voltage. The piezoelectric actuator is deformed while the applied voltage is maintained at the predetermined voltage. With the "fill before fire" method, the piezoelectric actuator is kept at the deformed shape for the long period of time.

With conventional technology, the piezoelectric actuator will be kept at the deformed shape while the predetermined voltage is being applied. The release of the piezoelectric actuator from the deformed shape will only occur while zero voltage is being applied to the piezoelectric actuator and this period is much shorter than the period while the piezoelectric actuator is kept at the deformed shape. There may be long period of time in which ink is not discharged from the nozzle. In such a case, the piezoelectric actuator is kept at the deformed shape without releasing for the long period of time. The period in which ink is not discharged is referred to as a non-discharge period. With a conventional inkjet printer, when the non-discharge period is long, the piezoelectric actuator is kept at the deformed shape without any shape change for the long period of time.

According to researches performed by the inventors, it was discovered that when an ink discharge operation having a comparatively long interval is repeated for a long period of time, a characteristic of the piezoelectric actuator will change. In other words, when the piezoelectric actuator is kept at the deformed shape over a comparatively long non-discharge period, and the deformed shape is shortly released between consecutive non-discharge periods, a characteristic of the piezoelectric actuator will change. The characteristic of the piezoelectric actuator is the correlation between the voltage that is applied to the piezoelectric actuator and the deformation amount of the piezoelectric actuator. This phenomenon is assumed to be caused by changes in the polarization structure of the piezoelectric actuator, and this change is assumed to be caused when the piezoelectric actuator is kept at the deformed shape over long period of time and the deformed shape is shortly released between consecutive non-discharge periods. The reason for this phenomenon will be described later.

With the conventional "fill and fire" method type inkjet printer, there is a possibility that the ink discharge characteristics will change when the inkjet printer is used for a long period of time.

An object of the present invention is to provide an inkjet printer in which the ink discharge characteristics will rarely change, even if the inkjet printer is used for a long period of time.

An inkjet printer according to the present invention has an inkjet head and a controller. The inkjet head has a piezoelectric actuator, a pressure chamber, and a nozzle. The controller can apply voltage to the piezoelectric actuator. The piezoelectric actuator forms a portion of a wall defining the pressure chamber, and the piezoelectric actuator deforms so as to project toward the pressure chamber and to decrease a volume of the pressure chamber while the controller applies voltage to the piezoelectric actuator.

The controller applies an ink discharge signal to the piezoelectric actuator when ink discharge operation is required. The ink discharge signal comprises an advanced voltage change from a predetermined voltage to zero voltage. When voltage applied to the piezoelectric actuator is changed from the predetermined voltage to zero voltage, the piezoelectric actuator having been deformed to project toward the pressure chamber is released from its deformed shape; therefore, the volume of the pressure chamber is increased. The ink discharge signal also comprises a subsequent voltage change from zero voltage to the predetermined voltage. When voltage applied to the piezoelectric actuator is changed from zero voltage to the predetermined voltage, the piezoelectric actuator having been released is deformed again to project toward the pressure chamber; therefore, the volume of the pressure chamber is decreased. The subsequent voltage change is delayed for a predetermined period from the advanced voltage change. The predetermined period is selected so that the subsequent voltage change is applied to the piezoelectric actuator when the pressure within the pressure chamber is increased to positive pressure due to the pressure wave generated by the advanced voltage change. The subsequent voltage change applied at this timing effectively increases the pressure within the pressure chamber; therefore, ink is effectively discharged from the nozzle. The combination of the volume increase and the subsequent volume decrease of the pressure chamber due to the ink discharge signal causes effective ink discharge operation from the nozzle.

The controller further applies an additional signal to the piezoelectric actuator. The additional signal comprises an advanced voltage change from the predetermined voltage to a lower voltage and a subsequent voltage change from the lower voltage to the predetermined voltage. The lower voltage may be zero voltage or between zero voltage and the predetermined voltage. When the lower voltage is higher than zero voltage but lower than the predetermined voltage, the period from the advanced voltage change to the subsequent voltage change may be equal to the predetermined period from the advanced voltage change to the subsequent voltage change of the ink discharge signal. When the period from the advanced voltage change to the subsequent voltage change of the additional signal is different from the predetermined period of the ink discharge signal, the lower voltage may be zero voltage. In any case, the combination of the volume increase and the subsequent volume decrease of the pressure chamber due to the additional signal does not cause ink discharge operation from the nozzle.

The controller applies at least one additional signal during an interval from an end timing of an advanced ink discharge signal to a start timing of a subsequent ink discharge signal. The controller applies at least one additional signal while the inkjet printer does not discharge ink from the nozzle. It may be possible that during the interval from the advanced ink discharge signal to the subsequent ink discharge signal, the inkjet printer is turned off. In this case, the controller may apply at least one additional signal during an interval from the end timing of an advanced ink discharge signal to timing when the inkjet printer is turned off. The controller may also apply at least one additional signal during an interval from when the inkjet printer is turned on to the start timing of the following ink discharge signal. In this case, the subsequent ink discharge will be the first ink discharge after the inkjet printer is turned on.

The inkjet printer may have a plurality of pressure chambers, piezoelectric actuators and nozzles.

According to the aforementioned inkjet printer, the controller will make the piezoelectric actuator perform ink discharge operation by applying the ink discharge signal. In the ink discharge operation, the volume of the pressure chamber changes from V1 to V2 and returns to V1 within the predetermined period. Here, V1 is a volume of the pressure chamber when the controller applies the predetermined voltage to the piezoelectric actuator and V2 is a volume of the pressure chamber when the controller applies no voltage to the piezoelectric actuator. V1 is smaller than V2. The predetermined period is substantially the time that the pressure wave within ink passage propagates the AL (acoustic distance) described above. Ink within the pressure chamber will be discharged by means of this ink discharge signal.

According to the present inkjet printer, the piezoelectric actuator is loosened or freed from the deformed shape occasionally while the inkjet printer does not discharge ink. In other words, the controller can make the period in which the volume of the pressure chamber is continuously kept to be V1 due to the piezoelectric effect shorter than that of a conventional inkjet printer. Thus, as will be understood from the following embodiment, changes in the polarization structure of the piezoelectric actuator will be suppressed. Because of this, secular changes to the characteristics of the piezoelectric actuator can be reduced. An inkjet printer can be obtained in which the ink discharge characteristics thereof will be stable, even when the inkjet printer is used for a long period of time.

BRIEF DESCRIPTION OF THE DRAWINGS

FIG. 7(*b*) shows the changes in the potential of the individual electrode when the ink discharge signal shown in FIG. 7(*a*) is applied.

FIG. 13 shows the relationship between the length of the period while the pressure wave continues and the printing characteristics,

DETAILED DESCRIPTION OF THE INVENTION

Figure 1:
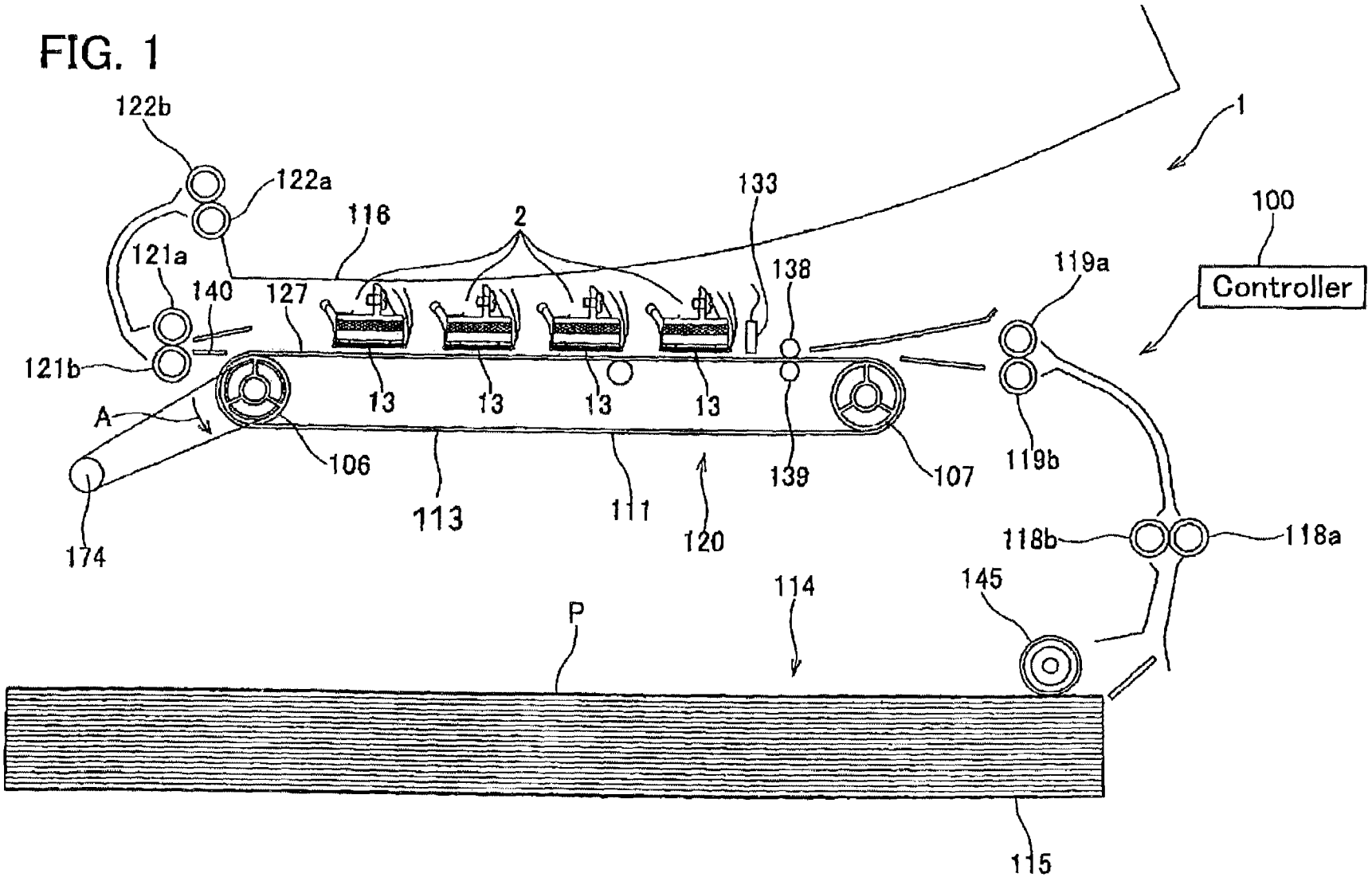
FIG. 1 is a schematic view of an ink jet printer of an embodiment.

Preferred technical features of the invention are described below.

The controller may apply the predetermined voltage to the piezoelectric actuator in a period from the end timing of the advanced ink discharge signal (that is equal to the start timing of non-discharge period) to a first timing within the non-discharge period, and in a period from a second timing within the non-discharge period to start timing of the subsequent ink discharge signal (that is equal to the end timing of non-discharge period). The second timing is later than the first timing but before the end timing of the non-discharge period.

The start timing of the non-discharge period is equal to the end timing of the advanced ink discharge operation. In other words, the start timing of the non-discharge period is equal to the end timing of the advanced ink discharge signal. The end timing of the non-discharge period is equal to the start timing of the subsequent ink discharge operation. In other words, the end timing of the non-discharge period is equal to the start timing of subsequent ink discharge signal.

According to the aforementioned technical features, the volume of the pressure chamber is maintained at V1 in the period from the end timing of the advanced ink discharge operation to the first timing by keeping the voltage applied to the piezoelectric actuator at the predetermined voltage.

Immediately after the ink discharge operation, pressure wave generated by the ink discharge operation survives in the pressure chamber. When the volume of the pressure chamber is changed before the pressure wave is sufficiently reduced, the ink may unintentionally leak from the nozzle. The ink can be prevented from unintentionally leaking from the nozzle by keeping the volume of the pressure chamber at volume V1 after the ink discharge operation is completed. The first timing is preferred to be the timing when the pressure wave is sufficiently reduced.

According to the aforementioned technical features, the volume of the pressure chamber is maintained at V1 in the period from the second timing to the start timing of the following ink discharge operation by keeping the voltage at the predetermined voltage. When the volume of the pressure chamber is changing immediately before the subsequent ink discharge operation, the pressure wave may remain turbulent during the ink discharge operation. When the pressure wave becomes turbulent during the ink discharge operation, the discharge characteristics of the ink may become non-uniform. When ink within the pressure chamber is maintained in a stable state immediately before the subsequent ink discharge operation by keeping the volume of the pressure chamber at V1 during the period from the second timing to the start timing of the following ink discharge operation, the stabilized ink can be discharged in the following ink discharge operation.

The piezoelectric actuator may be formed by stacking a piezoelectric film on a diaphragm that seals or caps the pressure chamber. The piezoelectric film may have electrodes attached on both surfaces for applying voltage thereto. A plurality of electrodes may be provided at a surface of the piezoelectric film so that each electrode opposes one corresponding pressure chamber The diaphragm may be made of piezoelectric material.

When the plurality of electrodes is arranged on one piezoelectric film, the volume of each of the plurality of pressure chambers can be changed independently. The piezoelectric actuator can be used with good space efficiency.

In addition, according to the aforementioned technical features, voltage will not be applied to the piezoelectric actuator at regions where electrodes are not arranged. Deformation will not be produced due to the piezoelectric effect on the regions. When the regions where electrodes are arranged and the piezoelectric film is deformed due to the piezoelectric effect, and the regions where electrodes are not arranged and the piezoelectric film is not deformed, coexist, stress will be concentrated in the border between two regions. In other words, when electrodes are arranged to correspond to the pressure chambers, the characteristics of the piezoelectric actuator will easily change near the boarder between the region opposing to the pressure chamber and the region not opposing to the pressure chamber. Even in this type, the period in which large amounts of stress are generated in the piezoelectric actuator can be shortened by setting the volume of the pressure chamber to be larger than V1 at least in a portion of the non-discharge period. Therefore, changes to the characteristics of the piezoelectric actuator over time can be reduced. In other words, ink can be stably discharged equally during long period of use.

In addition, the diaphragm and the piezoelectric film may be made of the same material by making the diaphragm with a piezoelectric material. The piezoelectric actuator can be manufactured at low cost.

One continuous piezoelectric film may extend over the pressure chamber, or one continuous diaphragm may extend, over the pressure chamber.

In either case, the entire wall at a side of the pressure chamber can be covered with the piezoelectric actuator. It can efficiently change the volume of the pressure chamber.

The controller may apply zero voltage to the piezoelectric actuator in a period from the first timing to the second timing. The period from the first timing to the second timing is different from the predetermined period of the ink discharge signal.

According to the aforementioned technical features, the controller will set the volume of the pressure chamber at V2 in the period from the first timing to the second timing by applying zero voltage to the piezoelectric actuator. Here, V2 is the volume of the pressure chamber when the controller applies zero voltage to the piezoelectric actuator. Therefore, the piezoelectric actuator can be in a state that is released from deformation, i.e., in a stress free state, in the period in which the controller sets the volume of the pressure chamber at V2. The change in the characteristics of the piezoelectric actuator over time can be effectively reduced by completely releasing the piezoelectric actuator from deformation at least in a portion of the non-discharge period. As long as the period at zero voltage of the additional signal is different from the predetermined period of the ink discharge signal, unintentional ink discharge does not occur.

The controller may apply zero voltage to the piezoelectric actuator in a period from the first timing to a third timing and may change the voltage applied to the piezoelectric actuator so as to monotonically increase from zero voltage to the predetermined voltage over a period from the third timing to the second timing. Here, the third timing is a point in time that is later than the first timing but prior to the second timing.

When the controller applies zero voltage during the period from the first timing to the third timing, the controller may change the voltage applied to the piezoelectric actuator so as to increase in a stepwise manner from zero voltage to the predetermined voltage over the period from the third timing to the second timing.

According to the aforementioned technical features, the volume of the pressure chamber gradually decreases from V2 to V1 over the period from the third timing to the second timing by applying voltage gradually changing over the period. Therefore, pressure wave can be prevented from being generated within the pressure chamber in the period from the third timing to the second timing. The volume of the pressure chamber is kept at V1 in the period from the second timing to the start timing of the subsequent ink discharge operation (i.e., start timing of the following ink discharge signal).

According to this aspect, pressure wave will not be generated within the pressure chamber in the period from the third timing to the start timing of the subsequent ink discharge operation. When the following ink discharge operation starts, the ink inside the pressure chamber can be placed in a stable state. The stabilized ink can be discharged in the subsequent ink discharge operation.

An inkjet printer may print characters or images on a printing medium with a minimum printing interval T0. Within the printing interval T0, the inkjet head moves with respect to the printing medium by a distance that is equal to a printing resolution. In other words, the printing interval T0 is the minimum interval between two consecutive ink discharge operations from the same nozzle. The printing interval T0 is determined by the relative moving speed of the inkjet head with respect to the printing medium, and the printing resolution required to the printer. When the inkjet printer discharged ink from one nozzle, the inkjet printer can not discharge ink until the printing interval T0 has elapsed. There will also be cases in which ink will not be discharged even the minimum interval T0 has elapsed, depending on the text or images that the inkjet printer is to print. In other words, the inkjet printer does not necessarily discharge ink from one nozzle with the printing interval T0.

In this case, the controller may apply voltage to the piezoelectric actuator such that a total amount of time while the voltage applied to the piezoelectric actuator is maintained at the predetermined voltage during the printing interval T0 is equal to or shorter than half of the printing interval T0.

According to experiments performed by the inventors, it was discovered that changes in the characteristics of the piezoelectric actuator can be effectively reduced by making the aforementioned total time to be no more than half the printing interval T0. In other words, according to the aforementioned technical features, changes in the characteristics of the piezoelectric actuator can be effectively reduced.

When the controller applies voltage so as to keep the above total time no more than half of the printing interval T0, there may exist a period in which zero voltage is applied to the piezoelectric actuator. In this case the period in which zero voltage is applied may be different from the predetermined period of the ink discharge signal.

According to the aforementioned technical features, the piezoelectric actuator will be released from deformation at least once during the printing interval T0. Because of this, changes to the characteristics of the piezoelectric actuator over time can be effectively reduced. Furthermore, since the period in which the applying voltage is maintained at zero is different from the predetermined period of the ink discharge signal, ink can be prevented from being unintentionally discharged from the nozzle due to this releasing operation.

In addition, according to the aforementioned technical features, only the period for maintaining at zero voltage is different from the ink discharge signal, therefore same controller may apply the ink discharge signal and the additional signal. In other words, the circuit in the controller for applying the ink discharge signal can also be used for applying the additional signal only changing the period of applying zero voltage different from the predetermined period of the ink discharge signal. This can simplify the controller.

When the predetermined voltage is applied to the piezoelectric actuator for the period from the second timing to the start timing of the subsequent ink discharge signal, that period may be preferably equal to or longer than half of a printing interval T0. The printing interval T0 is a period from the start timing of the advanced ink discharge signal for printing a first dot to the start timing of the subsequent ink discharge signal for printing a second dot separated from the first dot by a printing resolution. The printing medium travels a distance corresponding to the printing resolution during the printing interval T0 with respect to the printing bead.

According to researches performed by the inventors, it was discovered that if the ink within the pressure chamber is not disturbed prior to the start timing of the following ink discharge operation for at least half of the printing interval T0, the ink can be stably discharged in subsequent ink discharge operation.

According to the aforementioned technical features, the ink within the pressure chamber can be placed into a sufficiently stabilized state at the start timing of the following ink discharge operation, and the stabilized ink can be discharged in the subsequent ink discharge operation.

The controller may control the period from the start timing of the non-discharge period (end timing of the advanced ink discharge signal) to the first timing to be equal to or longer than the half of the printing interval T0.

When the volume of the pressure chamber is changed before the pressure wave generated by the previous ink discharge operation become sufficiently calm, the ink may unintentionally leak from the nozzle.

According to the aforementioned technical features, the volume of the pressure chamber will be kept at V1 for a period from the end timing of the previous ink discharge operation to the first timing, and his period is at least half of the printing interval T0. In other words, the volume of the pressure chamber will be kept at V1 for at least half of the printing interval T0 after the ink is discharged. Ink can be prevented from unintentionally leaking from the nozzle after the advanced ink discharge operation.

The non-discharge period may include a period in which the nozzle faces something other than the printing medium. The non-discharge period may also include at least one of a line feeding period and a page feeding period. That is, there may occur a case in which the inkjet head does not face a printing medium during the interval from the end timing of the advanced ink discharge signal to the start timing of the subsequent ink discharge signal, and the controller applies at least one additional signal while the case occurs. Alternatively, line feeding or paper feeding operation may be performed during the interval, and the controller applies at least one additional signal while the line feeding or paper feeding operation is performed.

By applying the additional signal during a period where the nozzle does not face the printing medium, a line feeding operation is performed, or a page feed operation is performed, in the non-discharge period, the characteristics of the piezoelectric actuator can be effectively prevented from changing, even when ink is not discharged for a long period of time.

Preferred embodiments of the present invention will be described with reference to the attached drawings.

<Outline Of The Inkjet Printer>

FIG. 1 is a schematic view of a color inkjet printer according to an embodiment of the present invention. This color inkjet printer 1 (hereinafter referred to as a printer 1) has four inkjet heads 2. These inkjet heads 2 are fixed to the printer 1. These inkjet heads 2 are arranged along the direction in which a printing sheet P is conveyed. Each inkjet head 2 has a long shape that extends from the front of FIG. 1 to the rear thereof A paper supply unit 114, a paper receiving section 116, and a conveying unit 120 are provided in the printer 1. In addition, a controller 100 is provided in the printer 1 in order to control the operation of each portion of the printer 1, such as the inkjet heads 2 and the paper supply unit 114.

The paper supply unit 114 has a paper storage case 115 that can store a plurality of printing sheets P, and a paper supply roller 145. The paper supply roller 145 can feed the uppermost printing sheet P of the printing sheets that are stacked and stored in the paper storage case 115, one sheet at a time.

A pair of feed rollers 118*a* and 118*b*, and a pair of feed rollers 119*a* and 119*b*, are arranged between the paper supply unit 114 and the conveying unit 120, and along the conveyance path of the printing sheets P. The printing sheet P fed from the paper supply unit 114 is further fed toward the conveying unit 120 by means of these feed rollers.

The conveying unit 120 has an endless conveyor belt 111, and two belt rollers 106 and 107. The conveyor belt 111 is wrapped around the belt rollers 106 and 107. The conveyor belt 111 is adjusted so that a predetermined tension is applied thereto when wrapped around the two belt rollers. In this way, the conveyor belt 111 is stretched between the two belt rollers 106 and 107 without any slack. The surface of the conveyor belt 111 near the inkjet head 2 is a conveying surface 127 that conveys the printing paper P.

As shown in FIG. 1, a conveying motor 174 is connected to the belt roller 106. The conveying motor 174 can rotate the belt roller 106 in the direction of the arrow A. In addition, the belt roller 107 can rotate in association with the conveyor belt 111. Thus, by driving the conveying motor 174 in order to rotate the belt roller 106, the conveyor belt 111 will rotate in the direction of the arrow A.

A nip roller 138 and a nip receiving roller 139 are arranged near the belt roller 107 so as to sandwich the conveyor belt 111. The nip roller 138 is urged downward by a spring not shown in the drawings. The nip receiving roller 139 below the nip roller 138 stops the nip roller 138 that is urged downward via the conveyor belt 111. The nip roller 138 and the nip receiving roller 139 are rotatably disposed, and rotate in association with the rotation of the conveyor belt 111.

Printing paper P fed from the paper supply unit 111 toward the conveying unit 120 is grasped between the nip roller 138 and the conveyor belt 111. In this way, the printing paper P is pressed onto the conveying surface 127 of the conveyor belt 111, and fixed on the conveying surface 127. Then, the printing paper P is conveyed in the direction in which the inkjet heads 2 are disposed, in accordance with the rotation of the conveyor belt 111. Note that the outer peripheral surface 113 of the conveyor belt 111 may be treated with an adhesive silicone rubber. In this way, the printing paper P can be reliably fixed to the conveying surface 127.

The four inkjet heads 2 are arranged near each other along the direction in which the printing paper P is conveyed by the conveyor belt 111. Each inkjet head 2 has a head main body 13 on the lower edge thereof. A large number of nozzles 8 (not shown in FIG. 1) that discharge ink are provided in the lower surface of the head main body 13. The same color of ink will be discharged from the nozzles 8 provided on one ink jet head 2. The colors of the ink discharged from each inkjet head 2 are, respectively, magenta (M), yellow (Y), cyan (C), and black (K). Each inkjet head 2 is arranged so that there is a slight gap between the lower surface of the head main body 13 and the conveying surface 127 of the conveyor belt 111.

A printing sheet P fixed to the conveying surface 127 of the conveyor belt 111 will pass between the inkjet head 2 and the conveyor belt 111. When this occurs, ink will be discharged from the nozzles 8 of the head main body 13 toward the upper surface of the printing sheet P. In this way, a color image based on image data stored by the controller 100 (see FIG. 6) will be printed on the upper surface of the printing sheet P.

A peel plate 140 and two pairs of feed rollers 121*a* and 121*b*, and 122*a* and 122*b*, are arranged between the conveying unit 120 and the paper receiving section 116. The printing paper P on which a color image has been printed is conveyed toward the peel plate 140 by the conveyor belt 111. At this point, the printing paper P is peeled from the conveying surface 127 by the right side of the peel plate 140 in FIG. 1. Then, the printing paper P is fed to the paper receiving section 116 by the feed rollers 121*a*-122*b*. Thus, printing papers P on which images have been printed will be sent to the paper receiving section 116. These printing papers P will be stacked onto the paper receiving section 116.

Note that a paper sensor 133 is disposed between the inkjet head 2 on the furthest upstream side in the direction in which the printing papers P are conveyed, and the nip roller 138. The paper sensor 133 is constructed from a light emitting element and a light receiving element. The paper sensor 133 will detect the leading edge of a printing sheet P in the conveying passage. The detection results are transmitted from the paper sensor 133 to the controller 100. The controller 100 will control the inkjet head 2, the conveying motor 174, and the like so that the conveyance of the printing paper P and the printing of the images are synchronized, based upon the detection signal transmitted from the paper sensor 133.

<Head Main Body>

Figure 2:
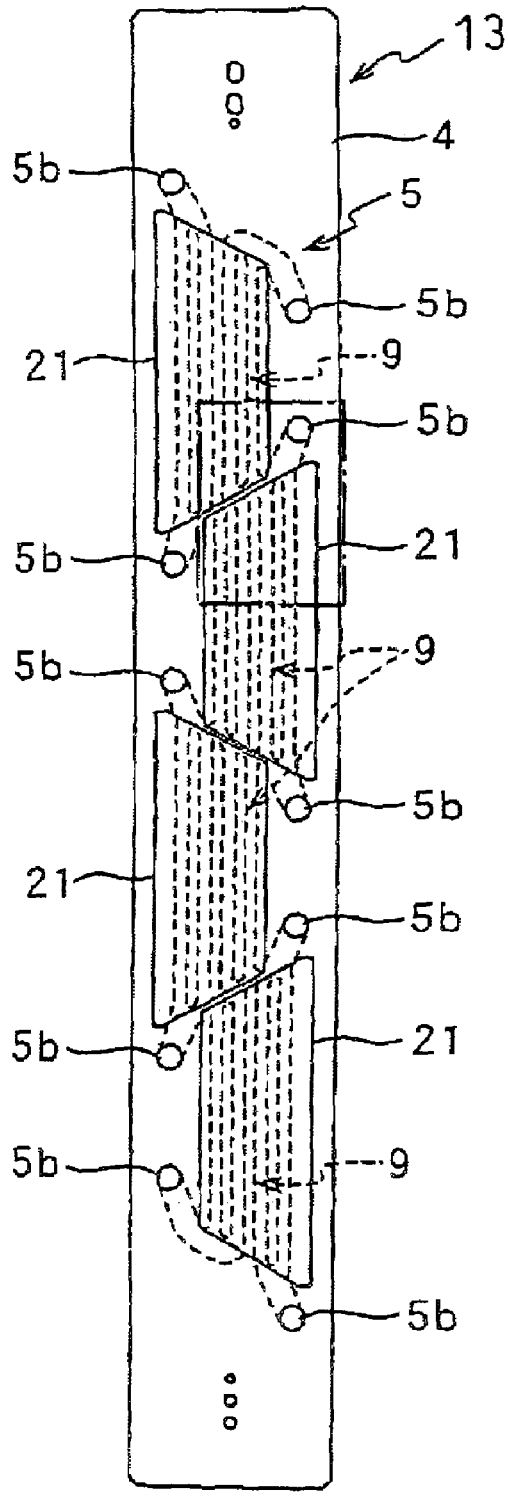
FIG. 2 is a plan view of a head main body shown in FIG. 1.

The head main body 13 will be described. FIG. 2 is a plan view of the head main body 13 shown in FIG. 1 when viewed from the upper surface thereof.

The head main body 13 has a passage unit 4, and actuator units 21 that are adhered to the passage unit 4. Each actuator unit 21 has a trapezoidal shape. The actuator units 21 are arranged on the upper surface of the passage unit 4 so that the pair of opposing parallel sides of each trapezoid is parallel with the lengthwise direction of the passage unit 4. In addition, four actuator units 21 are arranged on the upper surface of the passage unit 4 along the lengthwise direction of the passage unit. The adjacent actuator units 21 are arranged so that the trapezoids are arranged to face in opposite directions along the width of the passage unit 4. In addition, the adjacent actuator units 21 are arranged to be relatively offset along the width of the passage unit 4. A diagonal side of one trapezoid and adjacent diagonal side of the trapezoid adjacent to the one trapezoid partially overlap along the width of the passage unit.

A manifold passage 5 that is a portion of the ink passage is formed in the interior of the passage unit 4. Openings 5*b* of the manifold passage 5 are formed on the upper surface of the passage unit 4. Five openings 5*b* are arranged along one edge of the passage unit 4 in the lengthwise direction. Another five openings 5*b* are arranged along another edge of the passage unit 4 in the lengthwise direction. In the plan view of FIG. 2, the openings 5*b* are formed in positions outside the regions in which the four actuator units 21 are arranged. Ink is supplied from an ink tank not shown in the drawings, through the openings 5*b*, to the manifold passage 5.

Figure 3:
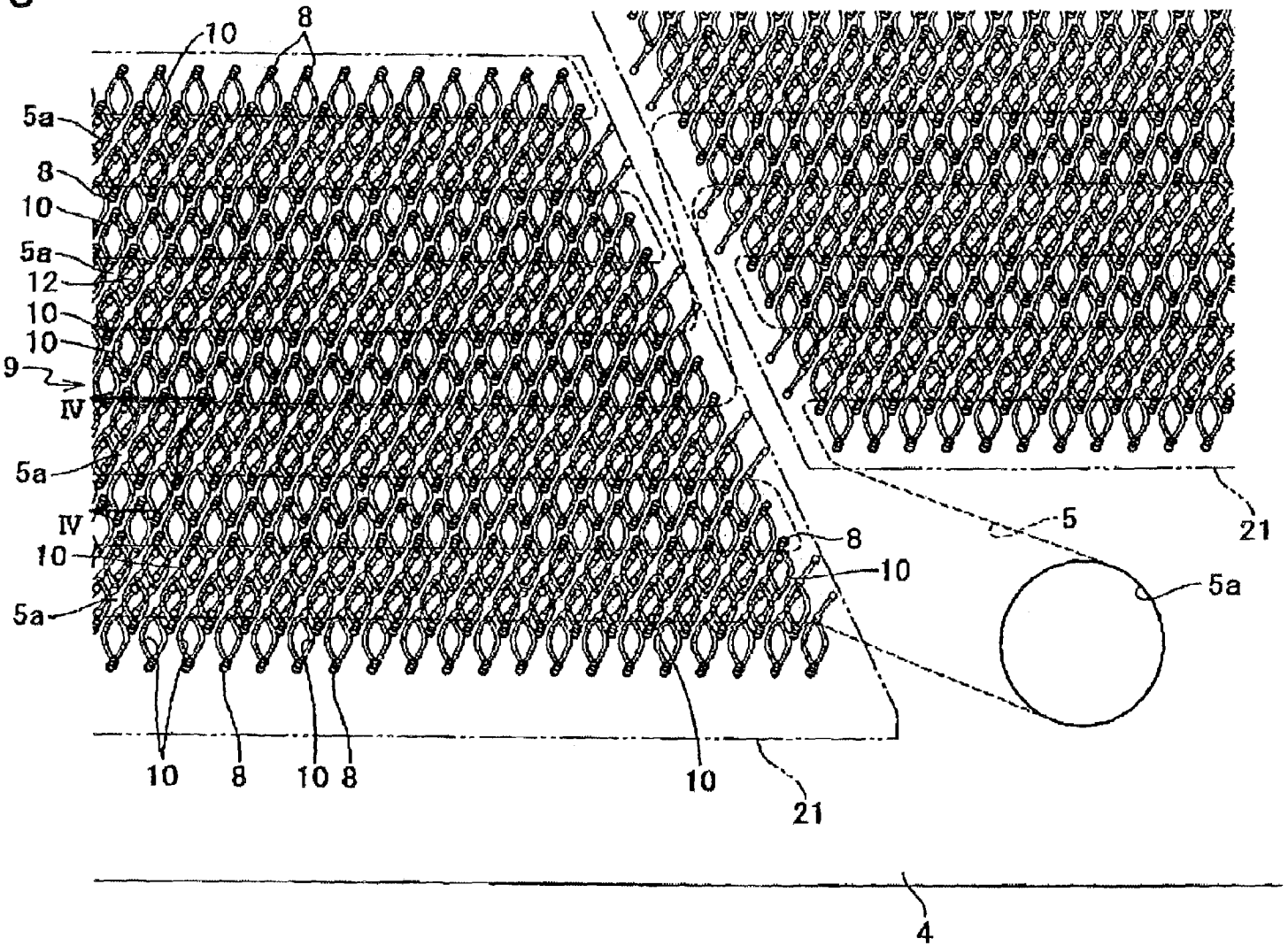
FIG. 3 is an enlarged view of the region that is surrounded with the thick broken line in FIG. 2.

FIG. 3 is an enlarged plan view of the region surrounded by the thick broken line of FIG. 2. Note that illustration of the actuator units 21 is omitted in FIG. 3 in order to make FIG. 3 easier to understand. In other words, FIG. 3 is a plan view of the head main unit 13 in a state in which the actuator units 21 are not arranged on the upper surface of the passage unit 4. In addition, the components formed in the interior and lower surface of the passage unit 4, such as apertures 12 and nozzles 8, should be shown with broken lines in FIG. 3, but are shown with solid lines therein.

A plurality of sub-manifold passages 5*a* branch from the manifold passage 5 formed inside the passage unit 4. These sub-manifold passages 5*a* extend inside the passage unit 4 so as to be mutually adjacent with the regions that are opposite each actuator unit 21.

The passage unit 4 has pressure chamber groups 9 in which the pressure chambers 10 are formed in a lattice pattern The pressure chambers 10 are hollow regions having a flat rhomboid shape in which the corners are rounded. The pressure chambers 10 are formed so as to open on the upper surface of the passage unit 4. These pressure chambers 10 are arranged along substantially the entire surface of the region that faces the actuator units 21 on the upper surface of the passage unit 4. In other words, the plurality of pressure chambers 10 are covered by the actuator units 21 on the upper surface of the passage unit 4. Each pressure chamber group 9 that are formed by these pressure chambers 10 have substantially the same size and shape as an actuator unit 21 in the direction perpendicular to the top surface of the passage unit 4.

A large number of nozzles 8 are formed on the lower surface of the passage unit 4. These nozzles 8 are arranged in positions that avoid the sub-manifold passages 5*a* in the plan view of FIG. 3. In addition, these nozzles 8 are arranged in regions that face the actuator units 21 in the plan view of FIG. 3. The nozzles 8 in each respective region are aligned in parallel lines in the lengthwise direction of the passage unit 4 with equal intervals.

The plurality of nozzles 8 are arranged as described below. Here, it will be assumed that there is an imaginary straight line that is parallel with the lengthwise direction of the passage unit 4. Projection points that project from every nozzle 8 along a direction perpendicular with the imaginary straight line toward the imaginary straight line are aligned with uniform, uninterrupted intervals. The interval corresponds to the print resolution. By arranging the nozzles 8 in this manner, the inkjet head 2 can print in uninterrupted intervals corresponding to the print resolution, along substantially the entire region in which the nozzles 8 are formed on the passage unit 4 in the lengthwise direction.

A large number of apertures (choke) 12 are formed in the interior of the passage unit 4. The apertures 12 are disposed in a region that faces the pressure chamber groups 9 in the plan view of FIG. 3. In the present embodiment, the apertures 12 extend along one direction that is parallel with the horizontal plane (the plane that is parallel with the plan view in FIG. 3).

Communication holes are formed in the interior of the passage unit 4. The communication holes are formed in order to mutually communicate with pressure chamber 10, the apertures 12 corresponding to the pressure chamber 11, and the nozzles 8 corresponding to the pressure chamber 10. These communication holes communicate with each other, and form the individual ink passages 32 (see FIG. 4). Each individual ink passage 32 communicates with the sub-manifold passages 5*a* at one end thereof. Ink supplied to the manifold passage 5 passes through the sub-manifold passages 5*a*, is branched to each individual ink passage 32, and is discharged from the nozzles 8.

<Individual Ink Passages>

Figure 4:
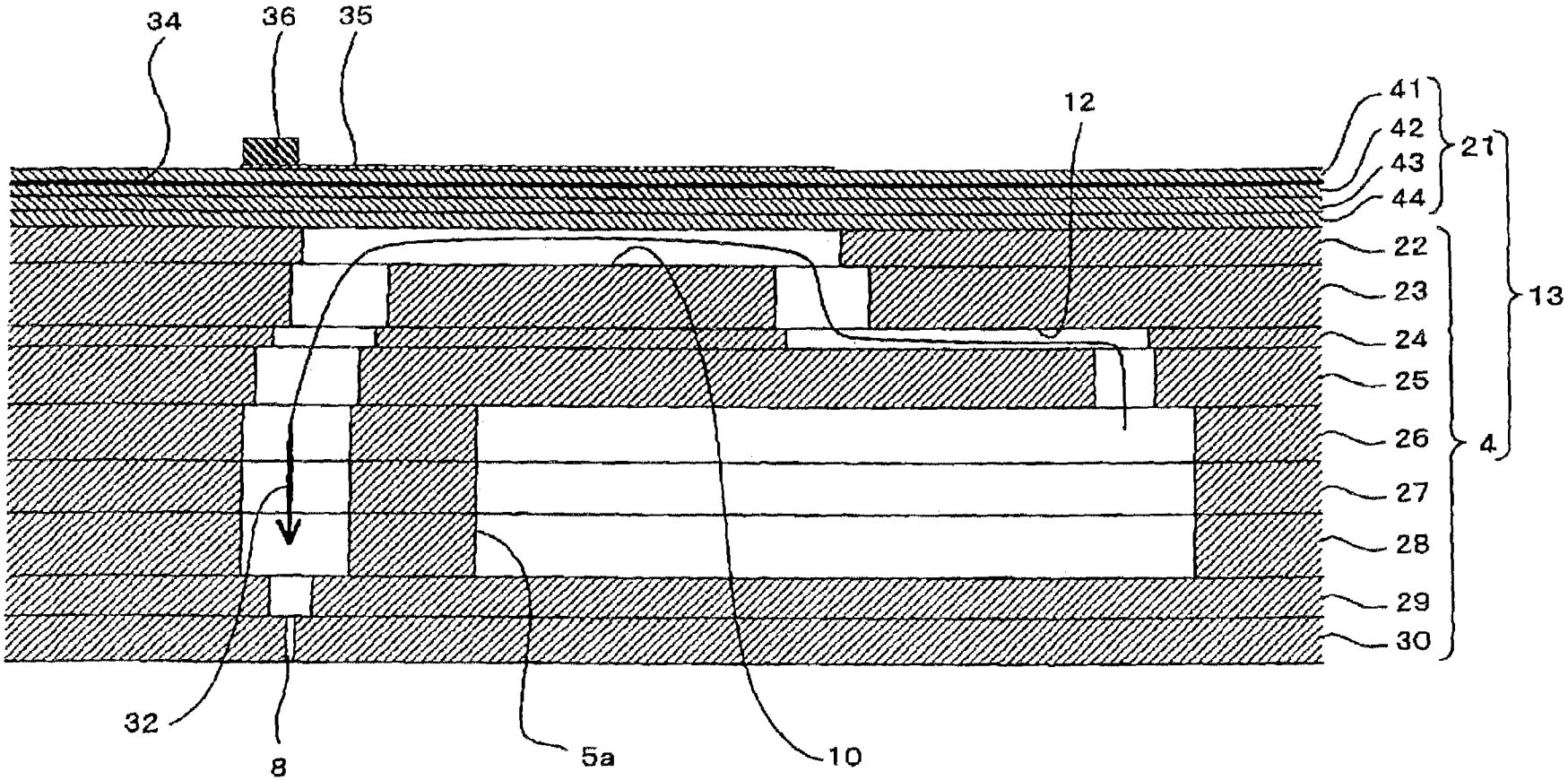
FIG. 4 is a vertical cross-sectional view corresponding to the line IV-IV shown in FIG. 3.

The individual ink passages 32 will be described with regard to the cross-sectional structure of the head main unit 13. FIG. 4 is a vertical cross-sectional view corresponding to line IV-IV shown in FIG. 3.

The passage unit 4 that is included in the head main unit 13 has a laminated structure in which a plurality of plates are laminated. These plates are, from the upper surface of the passage unit 4, a cavity plate 22, a base plate 23, an aperture plate 24, a supply plate 25, manifold plates 26, 27, 28, a cover plate 29, and a nozzle plate 30. A large number of communication holes are formed in these plates. When each plate is laminated, the communication holes formed in each plate communicate with each other so as to form the individual ink passages 32 and the sub-manifold passages 5*a*. In other words, each plate is positioned and laminated so that the individual ink passages 32 and the sub-manifold passages 5*a* are formed by means of the communication holes.

The communication holes formed in each plate will be described. The following elements are in these communication holes.

First, the pressure chambers 10 formed in the cavity plate 22.

Second, a communication hole group A that forms a passage that communicates from one end of the pressure chamber 10 to the sub-manifold passage 5*a*. The communication hole group A is formed in each plate from the base plate 23 to the supply plate 25. Note that the aperture 12 formed in the aperture plate 24 is included in the communication hole group A.

Third, a communication hole group B that forms a passage that communicates from the other end of the pressure chamber 10 to the nozzle 8. The communication hole group B is formed in each plate from the base plate 23 to the cover plate 29.

Fourth, the nozzle 8 formed in the nozzle plate 30.

Fifth, a communication hole group C that forms the sub-manifold passage 5*a*. The communication hole group C is formed in the manifold plates 26-28.

The individual ink passages 32 are formed due to the mutual communication of the communication holes. Ink supplied to the sub-manifold passage 5*a* will flow to the nozzle 8 through the individual ink passage 32 by following way. The ink will flow upward from the sub-manifold passage 5*a* to one end of the aperture 12. Next, the ink will flow horizontally along the lengthwise direction of the aperture 12 to the other end of the aperture 12. The ink will flow upward from the other end of the aperture 12 to one end of the pressure chamber 10. Furthermore, the ink will flow horizontally along the lengthwise direction of the pressure chamber 10 to the other end of the pressure chamber 10. The ink will flow from the other end of the pressure chamber 10 diagonally downward through the ink passage 32 that passes through three plates (the base plate 23, the aperture plate 24, and the supply plate 25). The ink will then flow to the nozzle 8 formed in the nozzle plate 30, via the ink passage 32 that passes through four plates (the manifold plates 26-28, and the cover plate 29).

<Actuator Units>

As shown in FIG. 4, the actuator unit 21 has a laminated structure in which four plates are laminated together, i.e., piezoelectric films 41, 42, 43, and 44. These piezoelectric films 41-44 each have a thickness of approximately 15 μm. The overall thickness of the actuator unit 21 is approximately 60 μm. Any layer of the piezoelectric films 41-44 extends so as to cover the plurality of pressure chambers 10 (see FIG. 3). In other words, as shown in FIG. 4, the actuator unit 21 forms a portion of the wall defining the pressure chamber 10.

These piezoelectric films 41-44 are comprised of lead zirconate titanate (PZT) type of ceramic material having ferroelectric properties.

The actuator unit 21 has two types of electrodes that are comprised of a metal material such as Ag—Pd or the like. The first electrode is an individual electrode 35. The individual electrode 35 is arranged on the upper surface of the piezoelectric film 41 in a region corresponding to the pressure chamber 10 in a stacking direction of piezoelectric films 41-44. A land 36 is formed on one end of the individual electrode 35. The land 36 is composed of a metal that includes, for example, glass frit. The land 36 is formed on the upper surface of the individual electrode 35, and in a convex shape having a thickness of approximately 15 μm. In addition, the land 36 is electrically bonded to a contact arranged on a FPC (Flexible Printed Circuit) not shown in the drawings. As described below, the controller 100 can transmit various electrical signals (voltage pulse signals) to the individual electrode 35 through the FPC.

The second electrode is a common electrode 34. The common electrode 34 lays between the piezoelectric film 41 and the piezoelectric film 42. The common electrode 34 extends approximately the entire region of a contact surface between the piezoelectric film 41 and 42. In other words, the common electrode 34 extends in the region that faces the actuator unit 21 so as to cover all of the pressure chambers 10. The thickness of the common electrode 34 is approximately 2 μm. The common electrode 34 is grounded and is kept at ground potential.

As shown in FIG. 4, the individual electrode 35 and the common electrode 34 are arranged so as to sandwich only the uppermost piezoelectric film 41. The region of the piezoelectric film 41 sandwiched by the individual electrode 35 and the common electrode 34 will be referred to below as the active portion. In the present embodiment, the active portion is the region of the piezoelectric film 41 in which a voltage will be applied. The active portion will deform due to the piezoelectric effect when a voltage is applied thereto.

The region of the piezoelectric film 41 other than the active portion will be referred to as the non-active portion. In the actuator unit 21 of the present embodiment, only the uppermost piezoelectric film 41 includes the active portion, and the other piezoelectric films 42-44 do not include the active portion. The piezoelectric films 42-44 which do not include the active portion will deform in response to deformation of the piezoelectric film 41, because the piezoelectric films 41-44 are stacked together. Therefore, the piezoelectric films 42-44 serve as diaphragms. In other words, the actuator unit 21 has a so-called unimorph type structure.

Figure 5:
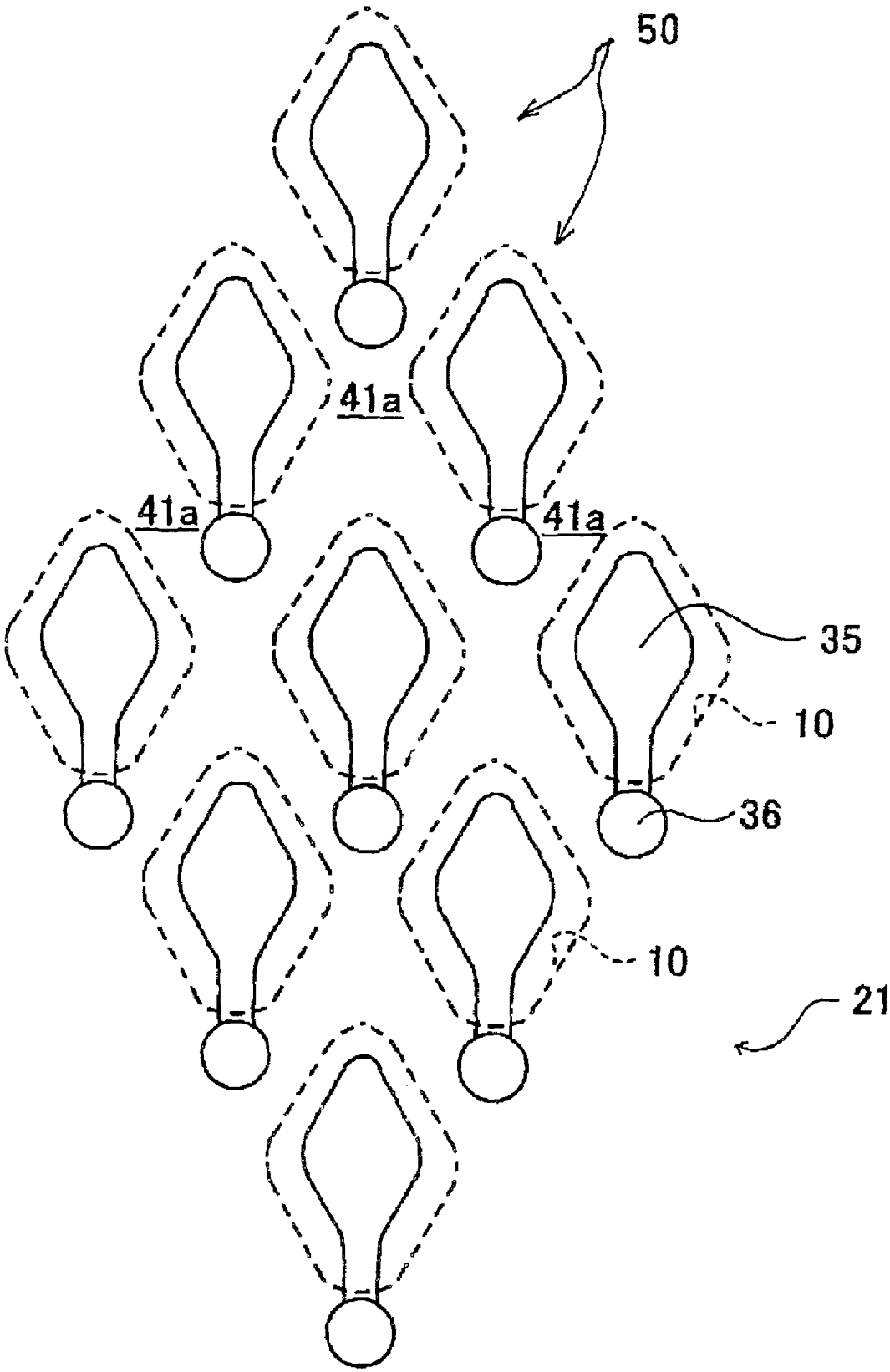
FIG. 5 is a partial enlarged plan view of the actuator unit shown in FIG. 2.

FIG. 5 is an enlarged plan view of the actuator unit 21 when viewed from the upper surface. The individual electrode 35 has a substantially flat rhomboid shape that is similar to the shape of the pressure chamber 10. The planar size of the individual electrode 35 is slightly smaller than that of the pressure chamber 10. One of the acute angular portions of the individual electrode 35 extends in a direction that is opposite that of the other acute angular portion. The tip of the extending portion forms the land 36. The land 36 has a flat circular shape.

The rhomboid shaped portion of the individual electrode 35 is arranged in the approximate center of the region that faces the pressure chamber 10 formed below the individual electrode 35. In contrast, the portion that extends from the acute angular portion of the individual electrode 35 extends beyond the region that faces the pressure chamber 10. In other words, the land 36 is arranged in a region 41*a* that faces a portion in which a pressure chamber 10 is not formed in the cavity plate 22.

Note that, as described below, by supplying selectively predetermined signals to the individual electrode 35, the region of the piezoelectric actuator unit 21 on which the individual electrode 35 is attached will deform so as to project toward the pressure chamber 10. In this way, the volume of the pressure chamber 10 will become smaller. Pressure will be applied to the ink inside the pressure chamber 10 that faces the individual electrode 35. As a result, ink will be pushed out from the pressure chamber 10 to the corresponding individual ink passage 32, and be discharged from the corresponding nozzle 8. In other words, the portions of the actuator unit 21 that face each pressure chamber 10 will form individual actuators 50 piezoelectric actuator) that corresponds to each pressure chamber 10 and nozzle 8. The individual actuator 50 forms a portion of the wall of each corresponding pressure chamber 10.

<Control Of The Actuator Unit>

Figure 6:
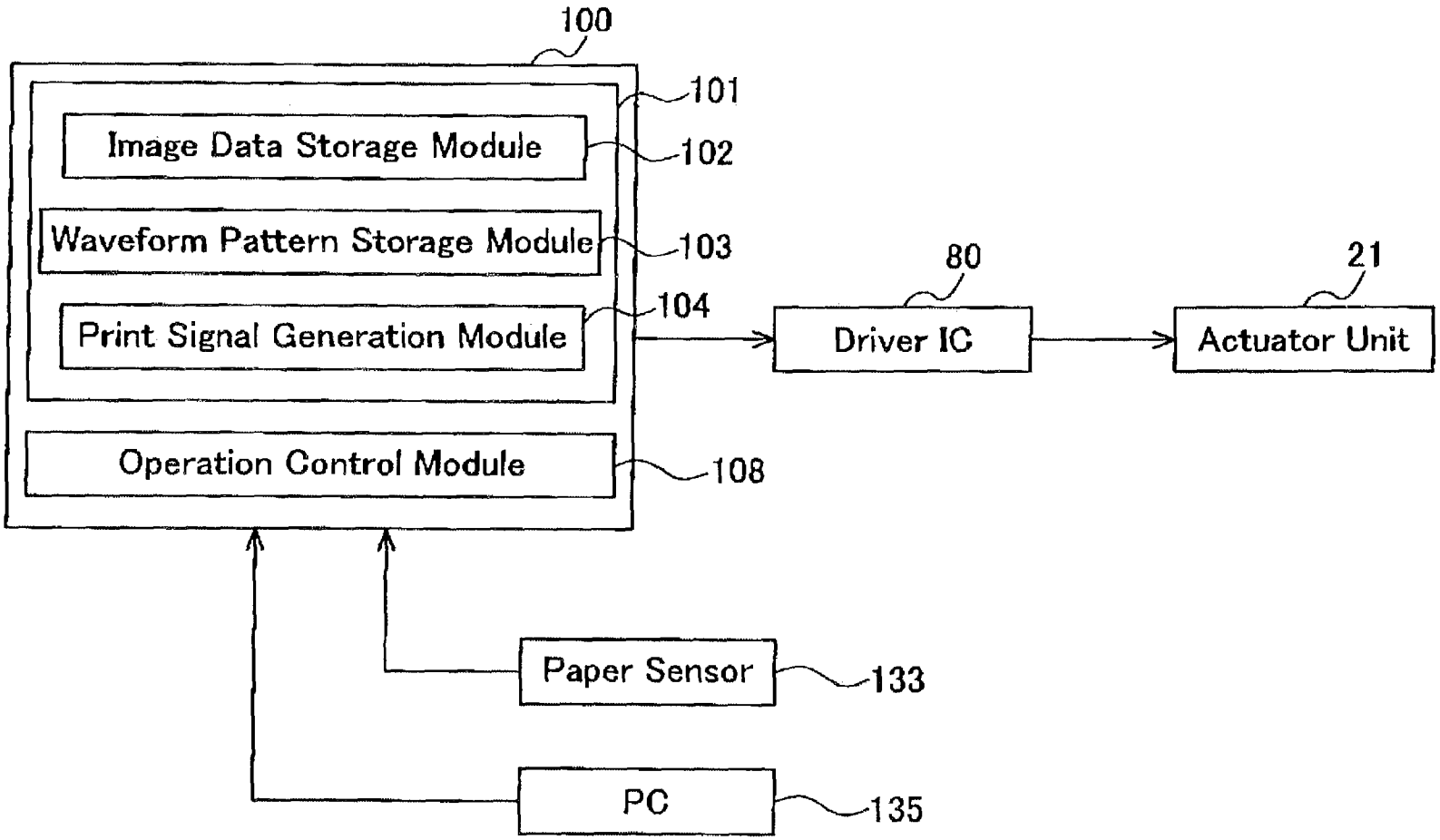
FIG. 6 is a block diagram of the control system of the inkjet printer.

The control of the actuator unit 21 will be described. FIG. 6 shows a block diagram of a control system of the printer 1.

Note that the printer 1 has a CPU (Central Processing Unit), a ROM (Read Only Memory) in which programs executed by the CPU and data used by the programs are stored, and a RAM (Random Access Memory) for temporarily storing data during program execution. Each function module that is described below is formed by these elements. The CPU, ROM, and RAM are omitted from the drawings.

The control system of the printer 1 includes a controller 100, a driver IC 80, the actuator unit 21, and the paper sensor 133 (see FIG. 1). The driver IC 80 and the paper sensor 133 are electrically connected to the controller 100. The actuator unit 21 is electrically connected to the driver IC 80.

The controller 100 has a print control module 101 and an operation control module 108. Operation data and image data related to the printing will be transmitted from the paper sensor 133 and an external PC (Personal Computer) 135 to the controller 100. The operation control module 108 will control the operation of a motor that drives the paper supply rollers 145, motors that drive the feed rollers 118*a*, 118*b*, 119*a*, 119*b*, 121*a*, 121*b*, 122*a*, 122*b*, a conveyor motor 174, and the like.

The print control module 101 has an image data storage module 102, a waveform pattern storage module 103, and a print signal generation module 104. The image data storage module 102 stores image data that was transmitted from the PC 135 or the like and is to be printed.

Figure 10:
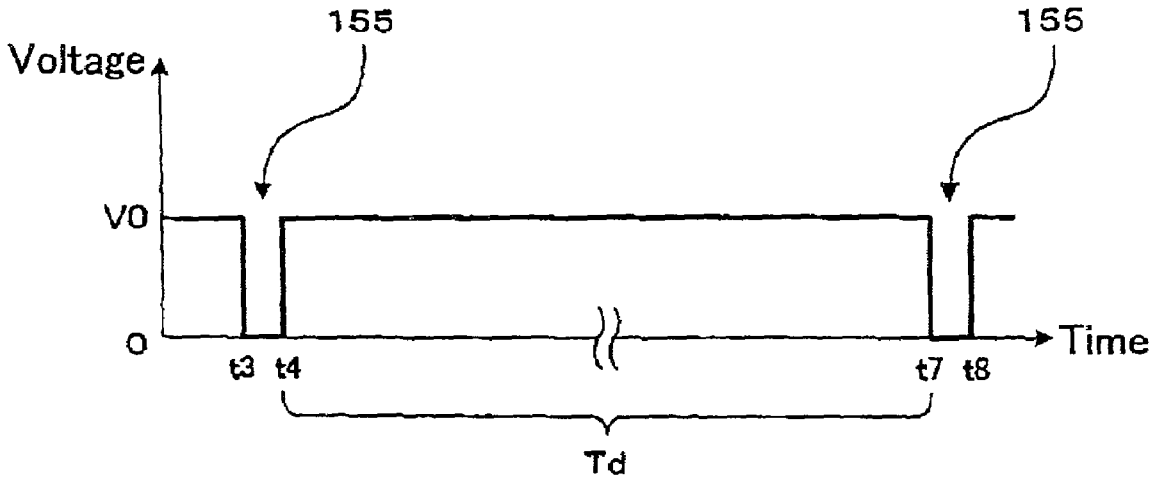
FIGS. 10(*a*), (*b*) are schematic graphs that show an example of the additional signals applied to individual electrode from the controller during non-discharge period.
Figure 10:
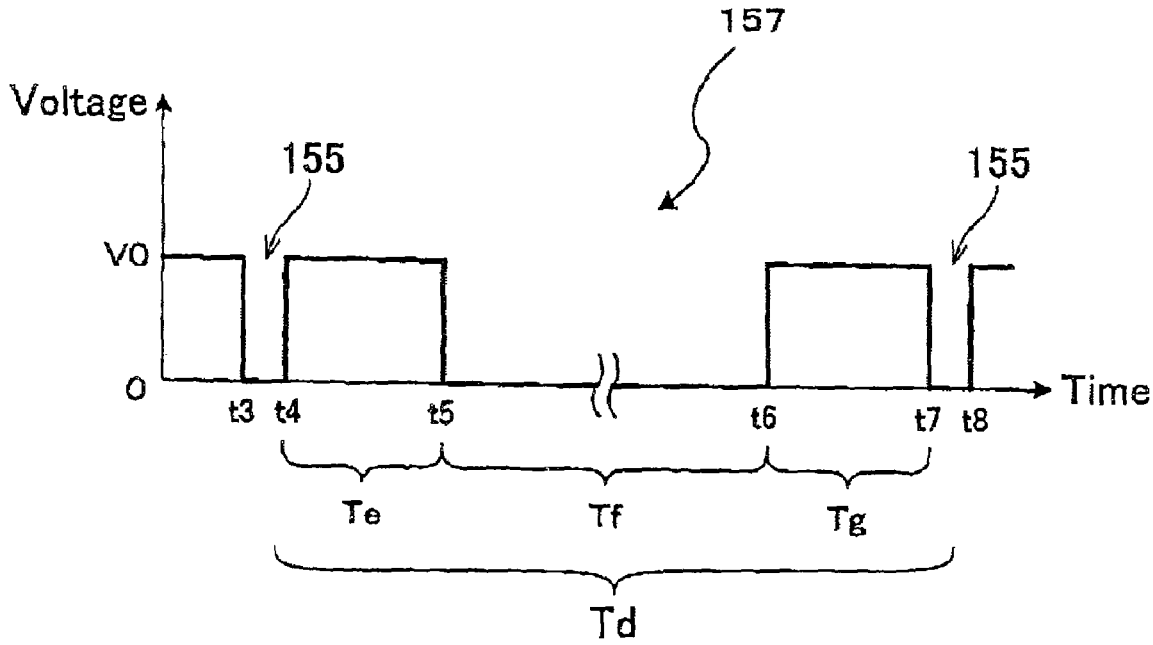
Figure 11:
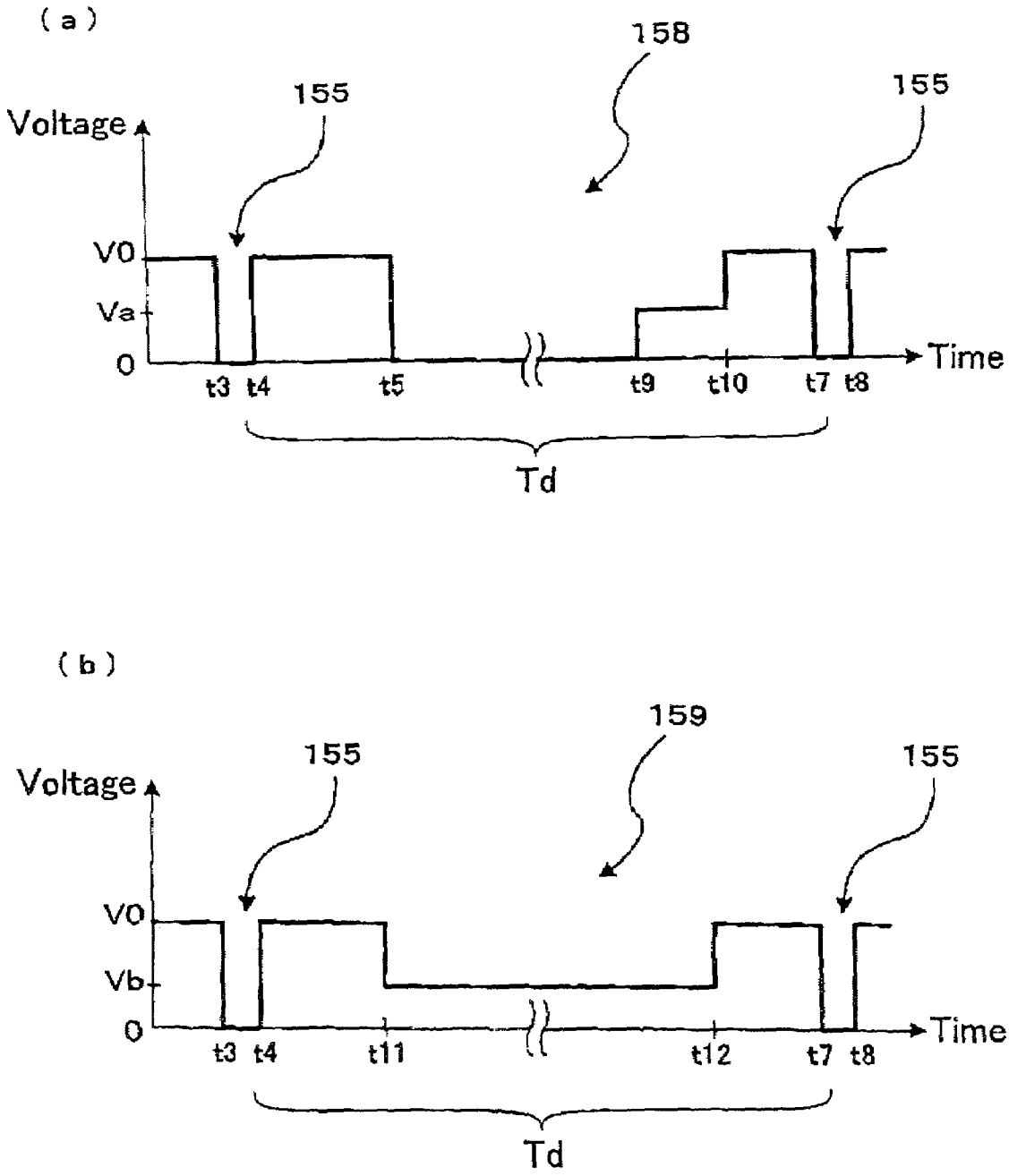
FIGS. 11(*a*), (*b*) are schematic graphs that show other examples of the additional signals applied to individual electrode from the controller during non-discharge period.

The waveform pattern storage module 103 stores a plurality of types of ink discharge signal patterns 155 (see FIG. 7) and additional signal patterns 157 (see FIGS. 10 and 11). Each respective signal pattern actually comprises an electrical pulse signal sequence. Each respective signal pattern is transmitted from the controller 100 to the actuator unit 21 via the driver IC 80. More specifically, each respective signal pattern is transmitted to the corresponding individual electrode 35.

The ink discharge signal pattern 155 is a basic signal pattern for expressing image tone. By using this type of signal pattern, a quantity of ink that corresponds to each respective image tone can be discharged by the inkjet head 2.

In contrast, the additional signal pattern 157 is, as described below, a signal pattern that serves to drive the actuator 50 in a period in which ink is not discharged. The additional signal pattern 157 releases the actuator 50 from a deformed shape, but does not discharge ink from the nozzle.

The print signal generation module 104 will generate print data based upon the image data stored in the image data storage module 102. The print data is data in serial format. The print signal generation module 104 will output the generated print data to the driver IC 80 that corresponds to each actuator unit 21.

The print signal generation module 104 will select a signal patter to be output to each individual electrode 35 from a plurality of signal patterns stored in the waveform pattern storage module 103 as the print data, so that the image to be printed will be printed. The print data also includes data that indicates the timing at which the selected signal pattern is to be output to the driver IC 80. More specifically, the print signal generation module 104 will generate print data, based on the image data, that will supply an ink discharge signal pattern 155 to the corresponding driver IC 80, so that ink will be discharged from a predetermined nozzle 8 at a predetermined timing. In addition, the print signal generation module 104 will calculate the periods in which ink will not be discharged from each nozzle 8 (non-discharge periods), based upon the image data and the conveyance status of the printing paper. Then, the print signal generation module 104 will generate and supply additional signal pattern 157 to the corresponding driver IC 80 in accordance with the calculated non-discharge period.

The driver IC 80 has a shift register, a multiplexer, and a drive buffer. The shift register, the multiplexer, and the drive buffer are omitted from the drawings.

The shift register will convert print data in serial format that was output from the print signal generation module 104 to data in parallel format. Simultaneously therewith, the shift register will convert print data to individual data for the actuator 50 that corresponds to each pressure chamber 10 and nozzle 8. The converted data will be output to the multiplexer.

The multiplexer will select a suitable signal pattern from amongst the plurality of types of ink discharge signal patterns and additional signal patterns, based upon the data output by the shift register. The multiplexer will output the selected data to the drive buffer.

The drive buffer will generate ink discharge signals and additional signals having suitable voltage levels for driving the actuator 50, based upon the ink discharge signal pattern and additional signal pattern output from the multiplexer. More specifically, these signals are voltage pulse train signals. The drive buffer will supply the generated signals to the individual electrodes 35 that correspond to each actuator 50, via the FPC.

<Transition Of The Electric Potential At The Individual Electrode During The Ink Discharge Operation>

The ink discharge signal, and the transition of the electric potential at the individual electrode 35 that receives this signal, will be described. For the purposes of the foregoing description, a printing interval T0 is defined as the amount of time needed to convey a printing sheet P a distance corresponding to a printing resolution, along the direction in which the printing sheet P is conveyed. In other words, the printing interval T0 means the minimum amount of time needed after ink is discharged from one nozzle 8 for ink to be discharged therefrom again. The printing interval T0 is determined by the speed at which the printing sheet P is conveyed, and the printing resolution of the printer 1.

Figure 7:
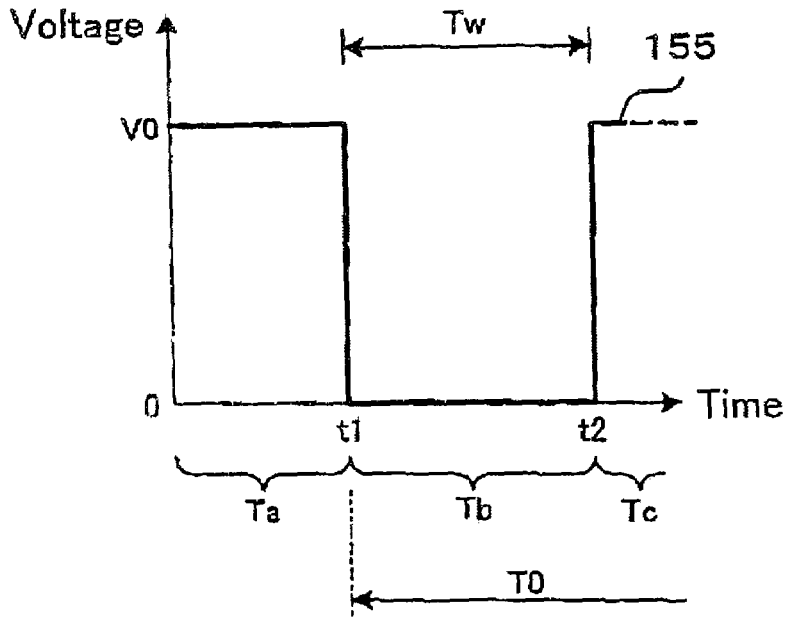
FIG. 7(*a*) is a schematic graph of the signal supplied to the individual electrode of the actuator unit for the ink discharge operation.
Figure 7:
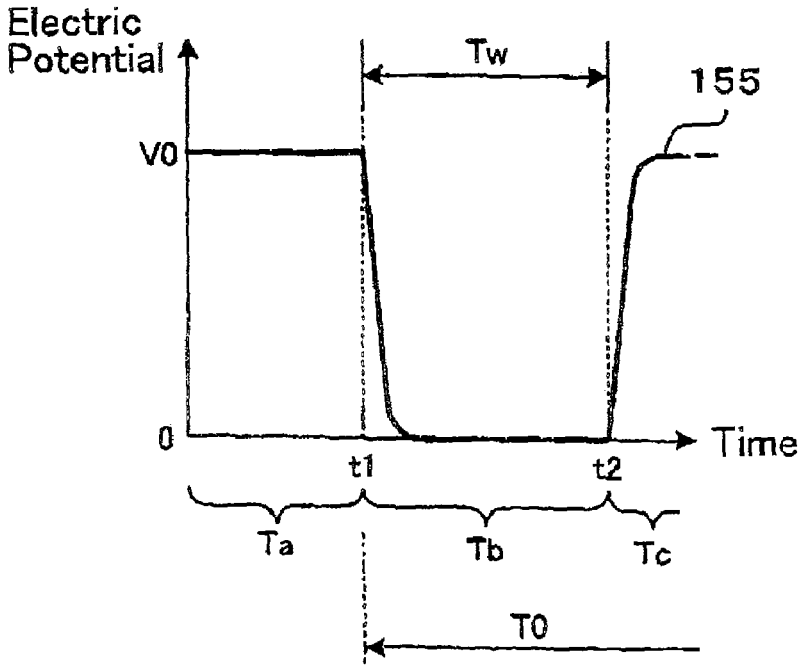

The voltage included in the ink discharge signal at each point in time will be described. FIG. 7(*a*) is a schematic graph showing a waveform 155 of an ink discharge signal supplied from the driver IC 80 to the actuator unit 21. Note that the waveform 155 of the ink discharge signal shown in FIG. 7 is an example of a waveform for causing one drop of ink to be discharged from nozzle 8 in a printing interval T0.

Time t1 is the time at which the ink discharge signal starts to be applied to individual electrode 35. Time t2 is the time at which the ink discharge signal ends. The voltage change at the time t1 is referred to as an advanced voltage change at a start timing of ink discharge signal. The voltage change at the time t2 is referred to as a subsequent voltage change at an end timing of ink discharge signal. Time t2 is adjusted at the timing at which ink is discharged from nozzle 8 that corresponds to the individual electrode 35. The time period Tw from the advanced voltage charge at the timing t1 to the subsequent voltage change at the timing t2 of the ink discharge signal 155 is set to satisfy a relation that the subsequent voltage change at the timing t2 is applied when positive pressure is developed within the pressure chamber due to the pressure wave generated by the advanced voltage change at the timing t1.

The voltage will be kept at a predetermined V0 in a period Ta that is prior to the start timing t1 of the ink discharge signal and a period Tc that is after the end timing t2 of the ink discharge signal time t2. The voltage will be kept at zero in period Tb. In other words, the ink discharge signal 155 comprises the advanced voltage change from the predetermined voltage V0 to zero voltage and the subsequent voltage change from zero voltage to the predetermined voltage V0. The subsequent voltage change is delayed form the advanced voltage change for the period Tb.

FIG. 7(*b*) shows the transition of electric potential at the individual electrode 35 when the waveform 155 of the aforementioned ink discharge signal is applied to the individual electrode 35.

As shown in FIG. 4, the individual electrode 35 and the common electrode 34 have a function that is equivalent to a condenser due to the piezoelectric film 41 acting as a dielectric. Thus, as shown in FIG. 7(*b*), the electric potential at the individual electrode 35 will transit including the delay corresponding to the charge/discharge time of the condenser.

<Operation Of The Actuator During The Ink Discharge Operation>

How the actuator 50 will be driven by supplying the aforementioned ink discharge signal to the individual electrode 35 will be described.

First, the status of the actuator unit 21 when the electric potential of the individual electrode 35 is at the potential other than ground potential (zero voltage) will be described. Only the uppermost piezoelectric film 41 of the actuator unit 21, in the present embodiment, is polarized along a direction extending from the individual electrode 35 to the common electrode 34. By making the electric potential of the individual electrode 35 different than that of the common electrode 34, a voltage can be applied to the piezoelectric film 41 in the same direction as of the polarized direction. When a voltage is applied to the piezoelectric film 41, the portion in which the voltage is applied, i.e., the active portion, will extend in the thickness direction due to the piezoelectric effect (the direction in which the piezoelectric films 41-44 are laminated). In addition, the active portion will contract in a direction that is perpendicular to the lamination direction, i.e., the planar direction of the piezoelectric film 41. In contrast to this, the remaining three piezoelectric films 42-44 will not actively deform, even if a voltage is applied thereto, because these films arc not polarized. Because the piezoelectric film 42-44 are laminated together with the piezoelectric film 41, the film 42-44 are passively deformed due to the deformation of the film 41 when the voltage is applied between the individual electrode 35 and the common electrode 34.

Thus, because bending will be generated between the piezoelectric film 41 and the piezoelectric films 42-44, the entirety of each actuator 50 will deform so as to project toward the pressure chamber 10 side (the piezoelectric films 42-44 side). This type of deformation will be referred to as unimorph deformation.

Figure 8:
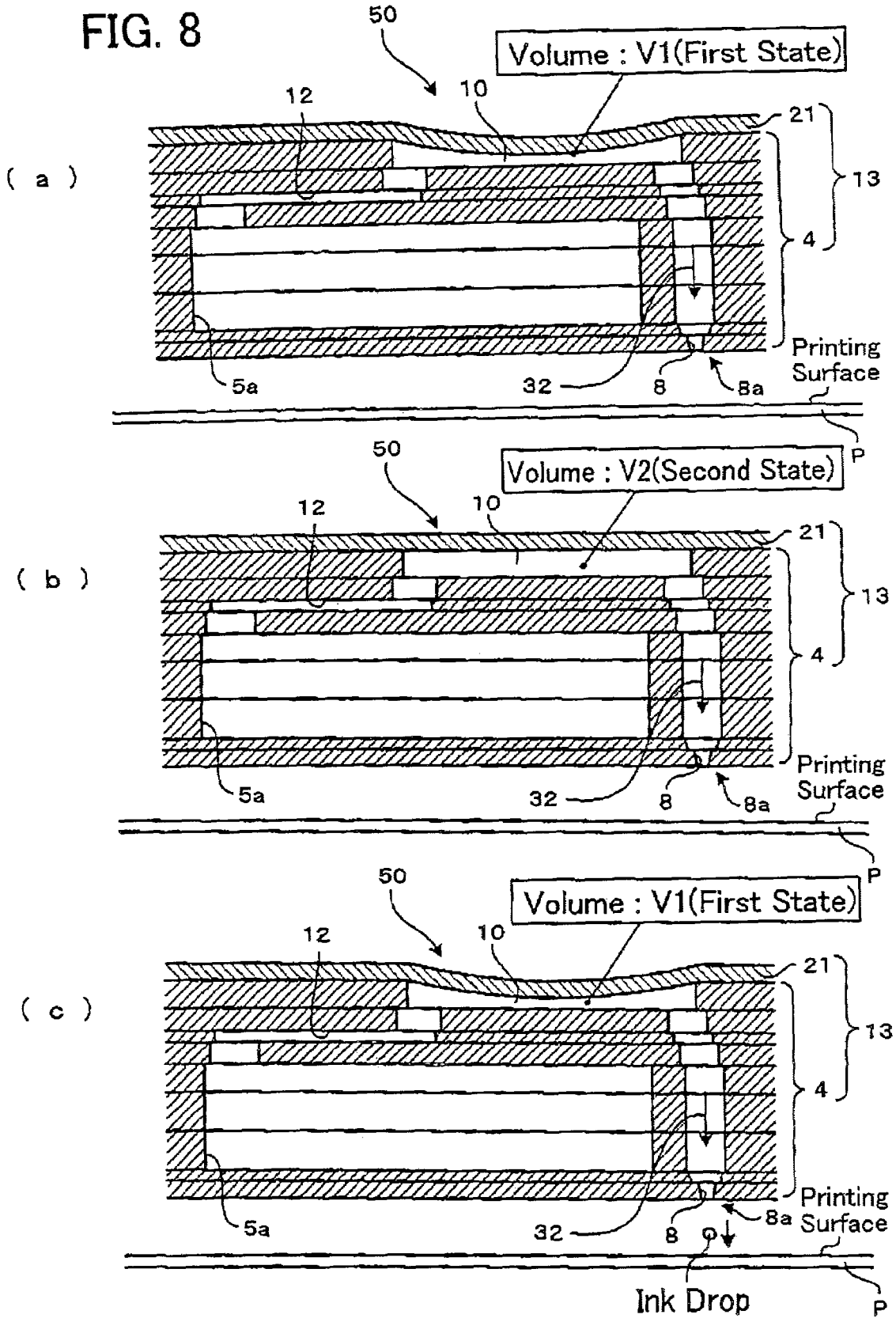
FIGS. 8(*a*)-(*c*) serve to explain the operation of the actuator unit, when the ink discharge signal that is shown in FIG. 7(*a*) is applied.

Next, the operation of the actuator 50 when the ink discharge signal 155 is applied to the individual electrode 35 will be described. FIGS. 8(*a*)-(*c*) show transition of the state of the actuator 50 during the ink discharge operation in this case. As shown in FIGS. 8(*a*)-(*c*), the actuator unit 50 forms the upper wall of the pressure chamber 10.

FIG. 8(*a*) shows the state of the actuator 50 during period Ta shown in FIG. 7(*b*). At this period, the electric potential of the individual electrode 35 is at the predetermined voltage V0. In contrast, the common electrode 34 is always kept at ground potential (see FIG. 4). The actuator 50 deforms due to unimorph deformation so as to project toward the inside of the pressure chamber 10. The volume of the pressure chamber 10 at His period is V1. In other words, when the predetermined voltage V0 is applied to the individual electrode 35, the volume of the pressure chamber 10 will be V1. The state of the actuator 50 at this period will be referred to as the first state.

FIG. 8(*b*) shows the state of the actuator 50 during period Tb shown in FIG. 7(*b*). At this period, the electric potential of the individual electrode 35 is zero voltage (ground potential). In other words, the active portion of the piezoelectric film 41 of the actuator 50 is in a state in which a zero voltage is applied. Thus, the unimorph deformation of the actuator 50 is released. The volume of the pressure chamber 10 at this period is V2. In other words, when a zero voltage is applied to the individual electrode 35, the deformation of the actuator 50 is released, and as a result, the volume of the pressure chamber 10 becomes V2. The volume V2 of the pressure chamber 10 is larger than the volume V1 of the pressure chamber 10 shown in FIG. 8(*a*). The state of the actuator 50 at this period will be referred to as the second state. Thus, as a result of the increase in the volume of the pressure chamber 10 from V1 to V2, ink will be drawn into the pressure chamber 10 from the sub-manifold passage 5*a*.

FIG. 8(*c*) shows the state of the actuator 50 during period Tc shown in FIG. 7(*b*). At this period, the electric potential of the individual electrode 35 is returned to V0. Thus, the actuator 50 will return again to the first state. By changing the actuator 50 from the second state to the first state, the pressure of the ink inside the pressure chamber 10 will increase. In this way, an ink drop will be discharged from the ink discharge opening 8*a* in the tip of the nozzle 8. The ink drop will strike the printing surface of the printing sheet P and form a dot on the printing sheet P.

Thus, during the ink discharge operation of the actuator 50, the volume of the pressure chamber 10 will first become temporarily enlarged (from the state shown in FIG. 8(*a*) to the state shown in FIG. 8(*b*)), and a negative pressure will be generated within the ink in the pressure chamber 10. The generated negative pressure will cause a pressure wave. The pressure wave will propagate the ink passage formed inside the passage unit 4. This pressure wave will propagate through the ink, and will reflect at the end portions of the ink passage. One end of the ink passage is the aperture 12. The other end of the ink passage is the nozzle 8. The pressure wave changes from a negative pressure to a positive pressure when reflected. The reflected pressure wave will return to the pressure chamber 10. When the pressure wave returns to the pressure chamber 10, positive pressure is developed within the pressure chamber 10. Subsequent voltage change from zero voltage to the predetermined voltage V0 is applied to the individual electrode 35 when the pressure wave returns to the pressure chamber 10 and positive pressure is developed within the pressure chamber 10.

The period Tw of the ink discharge signal 155 from the advanced voltage change at timing t1 to the subsequent voltage change at timing t2 is ideally the time that AL (Acoustic Length) is divided by penetrating speed of the pressure wave. Here, AL is the distance from the aperture 12 to the nozzle 8. The pressure chamber 10 is just a middle position between the aperture 12 and the nozzle 8. Note that the period Tw, in which the voltage of the individual electrode 35 changes from V0 to ground voltage, and again returns to V0, is substantially equivalent to the period in which the volume of the pressure chamber 10 changes from V1 to V2, and again returns to V1.

By making the period Tw as described, the positive pressure generated by the reflected pressure wave in the pressure chamber 10 will be superimposed over the positive pressure generated by the deformation of the actuator 50. In this way, a stronger positive pressure can be applied to the ink. Thus, as compared with simply reducing the volume of the pressure chamber one time in order to push ink out, the drive voltage of the actuator 50 for discharging the same quantity of ink can be reduced. Therefore, the aforementioned ink discharge operation is useful for increasing the integration of the pressure chambers 10, making the inkjet head. 2 more compact, and reducing the running cost when driving the inkjet head 2. The aforementioned ink discharge operation is referred to as "fill before fire".

<Change In The Characteristics Of The Piezoelectric Actuator>

It has been confirmed that when ink is continuously discharged for a long period of time under certain conditions by means of the aforementioned "fill before fire" method, changes will occur in the discharge characteristics of the actuator 50. For example, in the case where the actuator 50 is capable of being driven at a drive frequency that is more than 20 kHz, the ink discharge signal 155 will be supplied at a frequency that is much lower than the drive frequency. Then, after the ink discharge signal is applied a million times at a low frequency, a quantity of ink discharged from the nozzle 8 will decline. Also, the speed of the ink discharged from the nozzle is slowed. For example, when one million ink discharge signals are applied to the actuator 50 at 20 kHz, a prominent change in the discharge characteristics of the actuator 50 was not observed. However, when one million ink discharge signals were supplied to the actuator 50 at 2 kHz, a prominent change in the discharge characteristics of the actuator 50 was observed. In other words, when the ink discharge signal 155 is supplied to the actuator 50 at a frequency that is lower than the fastest drive frequency, a change in the discharge characteristics of the actuator 50 will occur. On the other hand, there was almost no change in the discharge characteristics of the actuator 50 when the voltage V0 is continuously applied to the actuator 50 for a period that one million ink discharge signals are applied of at 2 kHz.

Figure 9:
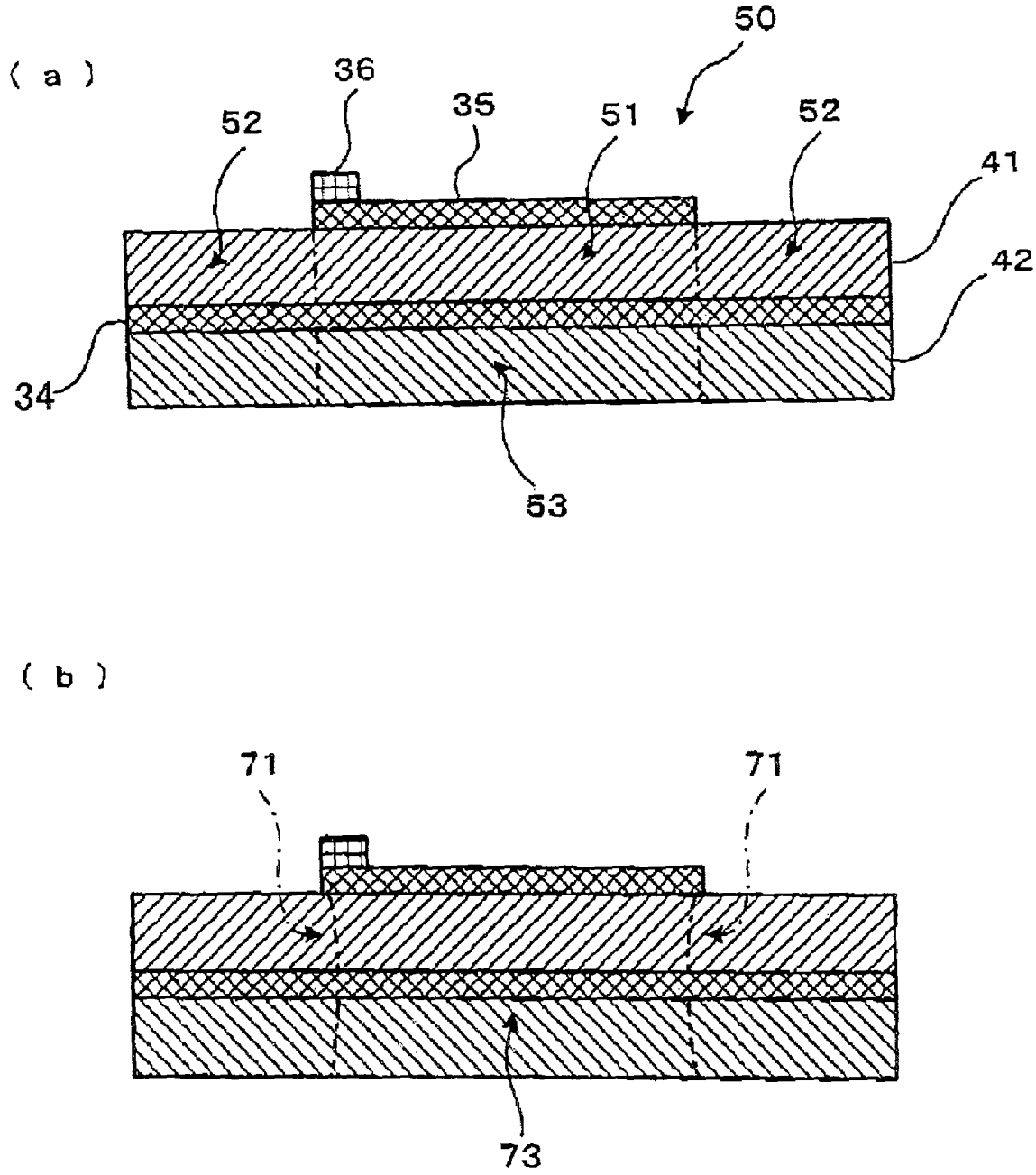
FIGS. 9(*a*), (*b*) serve to explain the characteristic changes produced in the actuator unit.

This type of change in the characteristics of the actuator 50 is assumed to be caused by the following mechanism. FIG. 9 explains the changes in the characteristics of the actuator 50.

The polarization of the piezoelectric film 41 will be explained prior to explaining the specific mechanism of the change in characteristics. The polarization of the piezoelectric film 41 is performed in order to increase the amount that the piezoelectric film contracts when a voltage is applied thereto. The polarization of the piezoelectric film is generally performed by applying a high voltage at a high temperature.

Ferroelectrics such as PZT have crystal gram units that have spontaneous polarization. However, there are various orientations of the spontaneous polarization of these crystal grain units prior to the polarization of the piezoelectric film. In this case, the piezoelectric film is not, as a whole, polarized along a uniform direction. In contrast, when a high voltage is applied to the piezoelectric film at a high temperature as described above, the direction of the spontaneous polarization of each crystal grain units can be placed in a particular direction. In this way, the piezoelectric film as a whole can be polarized along the particular direction. The expression "the direction of the spontaneous polarization can be placed along the particular direction" means that the direction of the spontaneous polarization for majority of the crystal grain units can be placed along a direction close to a single common direction. The expression does not mean that the direction of the spontaneous polarization for all of the crystal grain units is placed exactly in the single common direction. In other words, such expression in this embodiment means that the piezoelectric film, as a whole, can be polarized. Such kind of expressions is used as same meanings in this specification. In the present embodiment, the piezoelectric film 41 is substantially polarized along the direction of lamination. In other words, in the present embodiment, the piezoelectric film 41 is substantially polarized along a direction extending from the individual electrode 35 to the common electrode 34.

Here, the changes prior to the polarization of certain crystal grain units in the piezoelectric film, and the changes after the polarization thereof, will be considered. Each respective crystal lattice included in he crystal grain units, and each respective crystal lattice unit, have spontaneous polarization. Crystal lattices that are assembled in a spontaneous polarization direction are gathered inside the crystal grain unit, and form a large number of domains. Spontaneous polarization of crystal grain unit expresses the total amount of spontaneous polarization in the domains that are distributed inside the crystal grain unit. Prior to the aforementioned polarization process, the directions of the spontaneous polarization of the domains are random, and the crystal grain unit as a whole do not exhibit piezoelectric characteristics. In contrast, by polarizing the piezoelectric film, the crystal grain unit will exhibit piezoelectric characteristics, because the directions of spontaneous polarization of the domains inside the crystal grain unit align along the common direction (the direction in which the piezoelectric films 41-44 are laminated in the present embodiment).

Even if a polarization process is performed, the polarization directions of all the crystal lattices inside the crystal grain unit will not be aligned perfectly along the single common direction. There are domains inside the crystal grain unit after polarization in which the direction of spontaneous polarization aligns with the common direction, and there are also domains in which the directions of spontaneous polarization do not align with the common direction. Because these domains tend to have a certain distribution tendency, the crystal grain units as a whole will be polarized in the uniform direction. In the following explanation, the term "c-axis orientation" will be used to refer to the spontaneous polarization direction of each domain in a crystal grain being close to the lamination direction. In addition, the term "a-axis orientation" will be used to refer to the spontaneous polarization direction of each domain in a crystal grain being close to a direction that is perpendicular to the lamination direction (the lamination plane direction). Note that the degree of c-axis orientation that represents the extent of the c-axis orientation is observed as the intensity ratio of a 002 diffraction pattern with respect to 200 diffraction in X-ray diffraction. Amongst these, the 002 diffraction corresponds to the diffraction from a plane oriented on the c-axis of the crystal axis.

The mechanism by which a change of piezoelectric characteristics are produced in the piezoelectric film 41 will be explained below referring FIG. 9. As noted above, when ink is not discharged from the nozzle 8 corresponding to the actuator 50, a fixed voltage V0 is applied between the individual electrode 35 and the common electrode 34 (period Ta and Tc in FIG. 7). At these periods, the active portion 51 in the piezoelectric film 41 that is sandwiched between the two electrodes will contract along the planar direction of the piezoelectric film 41. Thus, the non-active portion 52 of the piezoelectric film 41 that is not sandwiched by the two electrodes will receive tensile stress along the planar direction due to the active portion 51.

When the ink discharge signal 155 is supplied to the individual electrode 35, the contraction of the active portion 51 will be temporarily released during the period Tw (see FIG. 7). The active portion 51 will return to the contracted state thereafter. Thus, the tensile stress received by the non-active portion 52 is also temporarily released only during period Tw, and the non-active portion 52 will return again to the tensile stress state thereafter.

In this type of situation, the ink discharge signal 155 will be continuously supplied to the individual electrode 35 at a predetermined low frequency. When this occurs, a phenomenon will occur in which the degree of c-axis orientation in the non-active portion 52 will gradually decline, and will not return to the former state. Because of this, the non-active portion 52 will be in a state that is elongated along the planar direction more than the initial state, as shown by the broken line 71 in FIG. 9(*b*). Thus, the active portion 51 will receive compression stress from the adjacent non-active portions 52.

The same situation will occur in the non-active portion 53 in the piezoelectric film 42. In other words, the active portion 51 will elongate in the direction of lamination when a voltage is applied to the active portion 51. At this point, the non-active portion 53 receives compression stress along the planar direction from the active portion 51. Thus, when the ink discharge signal 155 is continuously supplied to the individual electrode 35 at a low frequency, the c-axis orientation of the non-active portion 53 will increase. In this way, as shown by the broken line 71 in FIG. 9(*b*), the region 73 in the non-active portion 53 that faces the active portion 51 will contract along the planar direction. Thus, the active portion 51 will receive compression stress along the planar direction from the region 73.

Thus, the active portion 51 will receive compression stress from the periphery of the non-active portions. In this way, the degree of c-axis orientation in the active portion 51 will increase, and the distribution of the crystal orientation inside the crystal grain unit will change from its initial state. The displacement that occurs when an external voltage is applied to a polarized piezoelectric film is primarily observed as the sum of the warping (amount of strain) due to electrostriction that deforms in the c-axis direction of c-axis oriented crystal lattices and the warping caused by changes in the orientation of the domains (rotation of the crystal axis). However, in a state in which compression stress is steadily applied from the periphery, the domains that can change orientation by application of an external voltage will be reduced. As a result, the amount of compression of the active portion 51 will be reduced, and the initial piezoelectric characteristics will no longer be obtained.

<Operation Of The Actuator By Means Of Additional Signals>

The change in the characteristics of the piezoelectric actuator 50 will occur, as noted above, by applying the ink discharge signal 155 at a frequency that is lower than the maximum driving frequency. In other words, as shown in FIG. 10(*a*), when the ink discharge signal 155 is applied repeatedly at the time interval Td that is longer than the minimum printing period T0, the characteristics of the piezoelectric actuator 50 will change. The longer period Td corresponds to the aforementioned low frequency. The period Td from the end timing t4 of the advance ink discharge signal 155 to the start timing t7 of the subsequent ink discharge signal 155 shown in FIG. 10 indicates a period in which ink will not be discharged from the nozzle 8. This period Td will be referred to as a non-discharge period.

Note that when the ink discharge signal 155 shown in FIGS. 10 and 11 is applied to the corresponding individual electrode 35, the electric potential of the individual electrode 35 will change with the delay as shown in FIG. 7(*b*). The change in the electric potential that occurs in the individual electrode 35 with the delay is the same as noted above.

In the present embodiment, an additional signal 157 shown in FIG. 10(*b*) will be applied to the individual electrode 35 during the non-discharge period Td. The additional signal 157 comprises an advanced voltage change from the predetermined voltage V0 to a lower voltage (zero voltage in the case of FIG. 10(*b*)) at timing t5 (the first timing) and a subsequent voltage change from the lower voltage to the predetermined voltage V0 at timing t6 (the second timing). The applied voltage to the actuator 50 is lowered during a period Tf from timing t5 to timing t6 in the non-discharge period Td. In the period Tf, the electric potential of the individual electrode 35 will be lowered (to ground potential in the case of FIG. 10(*b*)). In contrast, the common electrode 34 is always kept at ground potential (see FIG. 4). In other words, a zero voltage will be applied to the actuator 50 in the period Tf. Thus, the actuator 50 will be kept in the second state in the period Tf (see FIG. 8(*b*)).

Because the actuator 50 is in the second state during the period Tf, the non-active portions 52 and 53 (see FIG. 9) will be released from the stress that would be applied from the active portion 51 during the period Tf The movement of the a-axis orientation and the c-axis orientation in the non-active portions 52 and 53 will, as noted above, occur due to the repeated application and release of stress at a low frequency. By supplying the additional signal 157 in the non-discharge period Td, the repeated application and release of stress at the low frequency can be avoided. In this way, changes in the crystal orientation in the non-active portions 52 and 53 can be reduced.

In addition, the controller 100 (see FIG. 6) can reduce the changes to the distribution of the orientation of the non-active portions 52 and 53 by applying at least one additional signal 157 to the actuator unit 21 in the non-discharge period Td. In other words, changes to the characteristics of the active portion 51 can be prevented. As a result, an inkjet printer can be obtained in which the ink discharge characteristics thereof will not change even when used for a long period of time.

Having the controller 100 (see FIG. 6) apply the additional signal 157 to the actuator unit 21 in the non-discharge period Td, means that the controller 100 will set the volume of the pressure chamber 10 to be larger than V1 during at least a portion of the non-discharge period Td. In the present embodiment, at least a portion of the period is the period from the first timing t5 and the second timing t6 shown in FIG. 10(*b*).

Note that at the second timing t6 at which the electric potential of the individual electrode 35 returns to V0 from the ground potential, a positive pressure wave will be generated within the pressure chamber 10 because the state of the actuator 50 will return to the first state from the second state. Thus, this pressure wave may have an impact on ink discharge at timing t7 and thereafter, and may decrease a printing quality. In order to avoid that type of decrease of the printing quality, it is preferable to ensure that the period Tg between the second timing t6 and the timing t7 at which the subsequent ink discharge operation starts, is sufficiently long.

FIG. 13 shows a relationship between the length of the period in which a pressure wave generated within the pressure chamber is substantially calmed or stabled, and the printing quality. The left column in FIG. 13 shows the ratio between period Tx and T0. Here, T0 represents the printing interval. In this example, T0 is 50 μs. Tx represents the period in which the pressure wave generated within the pressure chamber 10 is substantially calmed or stabled. In other words, the period (T0-Tx) represents the period in which a pressure wave is active or strong within one printing interval T0. The right column in FIG. 13 shows the results of an evaluation of the printing quality with the ratios shown in the left column. In the evaluation results, "Good" indicates that there is few decrease of the printing quality, and "Not Good" indicates that there is large decrease of the printing quality. Here, decrease of the printing quality is defined as the appearance of errors on printing images, in which the intended quantity of ink was not placed in the intended position on the printing medium. As shown in FIG. 13, the period Tx preferably has a length that is equal to or shorter than half of the printing interval T0. A pressure wave will be generated at the second timing t6 in FIG. 10(*b*) since the volume of the pressure chamber 10 is decreased from V2 to V1 at the second timing t6. As shown in FIG. 13, the period Tx is set to be equal to or shorter than half of the printing interval T0. Therefore, if the period Tg from the second timing t6 to the timing t7 is set to be equal to or longer than half of the printing interval T0, pressure wave generated at the second timing t6 is substantially calmed or stabled at the timing t7. The interval Tg from the second timing t6 to the timing t7 at which the non-discharge period Td ends is preferably equal to or longer than half of the printing interval T0. When the interval Tg is equal to or longer than half of the printing interval T0, the subsequent ink discharge signal is applied at the timing t7 when the pressure wave is already calmed or stabled.

In addition, a pressure wave will also be generated by applying an ink discharge signal at timings t3 and t4. The actuator 50 will change from the first state to the second state at the first timing t5. In other words, at timing t5, the volume of the pressure chamber 10 will change from V1 to V2, which generates a new pressure wave. Thus, by superimposing the pressure wave generated at timings t3 and t4 with the pressure wave generated at the first timing t5, there is a possibility of decreasing the printing quality. Here, decrease of the printing quality is defined to mean the unintentional leakage of ink from a nozzle 8. In order to reduce this type of decrease of the printing quality, the time interval of period Te from the timing t4 (the time at which the non-discharge operation starts) to the first timing t5 is preferably set to be equal to or longer than half of the printing interval T0.

As to the time period from the first timing t5 to the second timing t6, the timing should be different from the time period from the advanced change at t3 or t7 to the subsequent change at t4 or t8 of the ink discharge signal 155. As long as the time period from the first timing t5 to the second timing t6 is different form the time period of the ink discharge signal, the voltage change at the second timing t6 does not discharge the ink from the nozzle, because the voltage change at the second timing t6 is applied at a timing when the pressure within the pressure chamber is not at the peak of positive pressure.

<Other Additional Signals>

Other additional signals will be described with reference to FIG. 11.

First, an additional signal 158 shown in FIG. 11(*a*) will be explained, In the additional signal 158, a zero voltage is applied to the individual electrode 35 in a non-discharge period. Applying zero voltage to the individual electrode 35 is equal to, in other words, applying zero voltage to the piezoelectric actuator 50. The additional signal 158 will change the voltage to be applied to the individual electrode 35 from zero voltage to a voltage Va (0<Va<V0) prior to returning to the predetermined voltage V0. More specifically, the voltage in the additional signal 158 from timing t5 (the first timing) to timing t9 (the third timing) is zero. In other words, a voltage will not be applied to the actuator 50 in this period. The voltage from timing t9 (the third timing) to time t10 (second timing) is Va. The voltage from timing t10 to timing t7 is maintained at the predetermined voltage V0.

As shown FIG. 11(*a*), in the additional signal 158, voltage changes in a stepwise manner from zero to V0 in a period from timing t9 to timing t7.

When the additional signal 158 is applied to the individual electrode 35, the volume of the pressure chamber 10 changes from V2 (the period from timing t5 to timing t9), to a volume between V1 and V2 (the period from timing t9 to timing t10), and return to V1 (the period from timing t10 to timing t7). Thus, by means of this stepwise reduction of the volume of the pressure chamber 10, the magnitude of the pressure wave generated within the pressure chamber 10 becomes smaller than when the volume of the pressure chamber 10 suddenly returns to V2 from V1. Thus, the pressure wave at the ink discharge timing t7 can be prevented from having an impact on ink discharge operation. In addition, the unintentional leakage of ink from the nozzles between timing t9 and timing t7 can be prevented.

In addition, because the pressure wave generated when the volume of the pressure chamber 10 returns to V1 will be reduced by the additional signal 158, it will not be necessary to maintain a long period of time from timing t10 to timing t7. For example, length of the period may be shorter than the length of half of the printing interval T0.

Next, the additional signal 159 shown in FIG. 11(*b*) will be explained. In the additional signal 159, a voltage Vb which is between zero voltage and the predetermined voltage V0 (0<Vb<V0) is applied in a period from first timing t11 to second timing t12 within the non-discharge period Td (in a period from the end timing t4 of the advanced ink discharge signal to the start timing t7 of the subsequent sink discharge signal). The stress applied to the non-active portions 52 and 53 of the piezoelectric films 41 and 42 (see FIG. 9) in the period from first timing t11 to second timing t12, at which the electric potential of the individual electrode 35 is Vb, will be lessened by the additional signal 159. Thus, changes in the orientation distribution of the non-active portions 52 and 53 can be reduced, and changes in the characteristics of the active portion 51 can be reduced.

With the additional signal 159, the volume of the pressure chamber 10 will return to V1 at second timing t12 from a volume during the period from first timing t11 to second timing t12, which is between V1 and V2. Because of that, the pressure wave can be made smaller than when the volume suddenly returns to V1 from V2. Thus, the impact on the subsequent ink discharge operation at the timing t7 can be reduced. Furthermore, by making the pressure wave generated by the additional signal 159 weak, the ink can be prevented from unintentionally leaking from the nozzle while the additional signal 159 is applied.

In addition, like with the additional signal 158, there is no need to ensure that there is a long period of time from second timing t12 to the start timing of the subsequent ink discharge operation at t7. The period from timing t12 to timing t7 may be made shorter than half the length of the printing interval T0.

Figure 12:
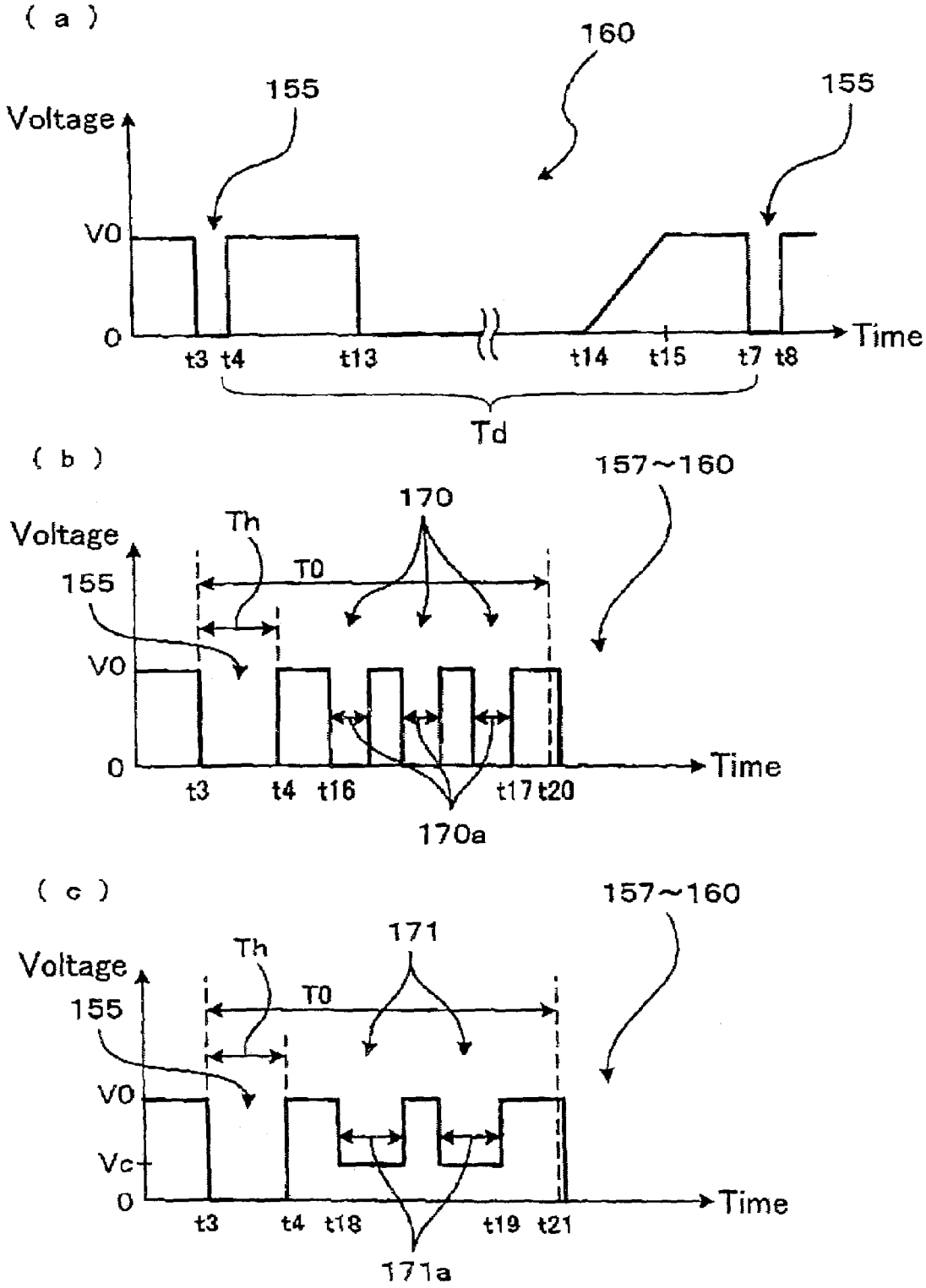
FIGS. 12(*a*)-(*c*) are schematic graphs that show other examples of the additional signals applied to individual electrode from the controller during non-discharge period.

Further additional signals will be described with reference to FIG. 12. An additional signal 160 is shown in FIG. 12(*a*). In the additional signal 160, zero voltage is applied to the individual electrode 35 during the period from first timing t13 to third timing t14 during the non-discharge period Td, and will linearly change the voltage from zero to the predetermined voltage V0 in the period from third timing t14 to second timing t15 during the non-discharge period Td. When returning to the predetermined voltage V0 from a state in which the voltage was kept at zero voltage, the deformation of the actuator 50 will become slower by changing the voltage so as to gradually and monotonically increase as shown by the additional signal 160 in FIG. 12(*a*). The volume of the pressure chamber 10 is V2 in the period from first timing t13 to third timing t14. Next, the volume will gradually increase from V2 to V1 in the period from third timing t14 to second timing t15. In this way, the generation of unnecessary pressure wave within the pressure chamber 10 can be substantially eliminated. Thus, the operation of the actuator 50 during the non-discharge period can be effectively prevented from impacting the ink discharge operation from the timing t7 to the timing t8.

Note that the change in the voltage from third timing t14 to second timing 15 may change in ways other than linear. For example, the voltage may be changed by smoothly increasing it so as to draw a gentle curve.

The method of switching between a non-discharge period and a printing interval that includes an ink discharge signal will now be explained. The non-discharge period may extend over two or more printing intervals T0. As noted above, the time interval in which ink is to discharged from one nozzle 8 depends upon the image to be printed, and ink will not necessarily be discharged in each printing interval T0.

The driving of the actuator 50 in the non-discharge period Td having a plurality of printing intervals T0 will be described below.

A range of one printing interval T0 in which an ink discharge signal is included is shown in FIG. 12(*b*) and FIG. 12(*c*). Each respective printing interval T0 is a period from start timing t3 of advanced ink discharge signal to a point in time after the length T0. The additional signals 170 and 171 are shown in FIG. 12(*b*) and FIG. 12(*c*). The additional signals 170 and 171 are series of signals that are supplied separately from the additional signals 157-160. The additional signals 170 and 171 are signals that are supplied from end timing t4 of the advanced ink discharge signal at which the non-discharge period starts, to the point in time at which the next printing interval begins. As shown in FIG. 12(*b*), the additional signal 170 comprises frequent changes from the predetermined voltage V0 to zero voltage and frequent changes from zero voltage to the predetermined voltage V0. The additional signal 170 comprises a series of a plurality of pulses. The periods in which the voltage is kept at zero are shown with reference numeral 170*a* in FIG. 12(*b*). In contrast, the additional signal 171 comprises frequent changes from the predetermined voltage V0 to an intermediate voltage Vc and frequent changes from the intermediate voltage Vc to the predetermined voltage V0. The intermediate voltage Vc is smaller than the predetermined voltage V0 and larger than zero voltage. The additional signal 171 comprises a series of a plurality of pulses. The periods in which the voltage is kept at the intermediate voltage Vc are shown with reference numeral 171*a* in FIG. 12(*c*).

Changes in the characteristics of the piezoelectric film 41 will be generated because the ink discharge signal 155 is supplied to the individual electrode 35 at a low frequency, and because the difference in electric potential between the individual electrode 35 and the common electrode 34 is kept at the predetermined voltage V0 in the non-discharge period that the ink discharge signal 155 is not applied. In other words, changes in the characteristics of the piezoelectric film 41 will be occurred because the regions of the actuator 50 that correspond to the pressure chamber 10 will change to zero voltage from the predetermined voltage (V0 in this embodiment) at a low frequency.

By adding the additional signal 170 and the like to the individual electrode 35, the difference in the electric potential between the individual electrode 35 and the common electrode 34 will be zero voltage at least once in one printing interval T0. In other words, by applying the additional signal 170 to the individual electrode 35, the volume of the pressure chamber 10 can change from V1 to V2 and return to V1 at least once in one printing interval T0. Because of this, applying zero voltage to the individual electrode 35 at a low frequency can be prevented. Thus, a change in the characteristics of the piezoelectric film 41 can be effectively reduced.

By adding the additional signal 157 and the like to the individual electrode 35, the difference in the electric potential between the individual electrode 35 and the common electrode 34 will become smaller than V0 at least once in one printing interval T0. In other words, by applying the additional signal 171 to the individual electrode 35, the volume of the pressure chamber 10 can become larger than V1 at least once in one printing interval T0. Because of this, applying zero voltage to the individual electrode 35 at a low frequency can be prevented. Thus, a change in the characteristics of the piezoelectric film 41 can be effectively reduced.

In addition, by applying additional signals 170 and 171, the meniscus at the nozzle 8 moves in association with the volume change of the pressure chamber 10. In this way, an increase in the viscosity of the ink inside the nozzle 8 can be avoided, even when the ink is not discharged for a long period of time.

It is assumed that whether or not changes in the characteristics of the piezoelectric film 41 are easily caused will depend upon the number of times the volume of the pressure chamber 10 changes, the time interval in which the volume of the pressure chamber 10 changes, and the periods in which the volume of the pressure chamber 10 changes. For example, when the total number of periods in which the volume of the pressure chamber 10 changes in one printing interval T0 shown in FIGS. 12(*b*) and 12(*c*) is too small, there will be times in which the effect of preventing changes in the characteristics of the piezoelectric film will not be sufficiently exhibited, even if a series of additional signals is applied.

Thus, in the range of one printing interval T0 shown in FIGS. 12(*b*) and 12(*c*), it is preferable that the total time of the signals for keeping the volume of the pressure chamber 10 at V2 is half or more of the one printing interval T0. In other words, in FIG. 12(*b*), it is preferable that the sum of the total of the periods 170*a* in which the voltage included in the additional signal 170 is kept at zero, and the period Th in which the voltage included in the ink discharge signal 155 is kept at zero, is half or more of the printing interval T0. Or, in FIG. 12(*c*), it is preferable that the sum of the total of the periods 171*a* in which the voltage included in the additional signal 171 is kept at Vc, and the period Th in which the voltage included in the ink discharge signal 155 is kept at zero, is half or more of the printing interval T0. Note that "the sum of the total of the periods 170*a* in which the voltage included in the additional signal 170 is kept at zero, and the period Th in which the voltage included in the ink discharge signal 155 is kept at zero, is half or more of the printing interval T0" is equivalent to the total periods in which the voltage in one printing interval T0 is kept at V0 being half or less of one printing interval T0 (in other words, the periods in which the volume of the pressure chamber 10 is kept at V1). Note that "the sum of the total of the periods 171*a* in which the voltage included in the additional signal 171 is kept at Vc, and the period Th in which the voltage included in the ink discharge signal 155 is kept at zero, is half or more of the printing interval T0" is equivalent to the total periods in which the voltage in one printing interval T0 is kept at V0 being half or less of one printing interval T0 (in other words, the periods in which the volume of the pressure chamber 10 is kept at V1).

Note that the additional signal 170 includes a signal in which the voltage is kept at zero between fixed periods. In other words, the additional signal 170 includes the same waveform pattern as the waveform pattern of the ink discharge signal 155. Thus, when the periods in which the voltage is kept at zero are the substantially same length as the periods in which the voltage is kept at zero in the ink discharge signal 155 (i.e., the period Th shown in FIG. 12(*b*)), ink will be unintentionally discharged from the nozzle 8 during the non-discharge periods. Thus, the periods included in the additional signal 170 in which the voltage is kept at zero need to be set at a length that is different than the period Th. For example, the width of the period 170*a* may be set so as to be shorter than the sum of the start and stop times corresponding to the transient phenomenon that occurs when pulse shaped voltage is applied to the actuator 50. As noted above, the electric potential of the individual electrode 35 will change with the time delay corresponding to the charge/discharge time of the condenser. The sum of the start time and the stop time corresponds to the time delay. By setting the width of the period 170*a* to be shorter than the time delay, the actuator 50 will return to its original state prior to attaining the electric potential corresponding to the change in voltage. As a result, the actuator 50 will oscillate to a degree that does not discharge ink. By setting the period 170*a* as noted above, the changes to the characteristics of the actuator 50 can be reduced without unintentionally discharging ink during the non-discharge periods.

In contrast, the additional signal 171 includes a signal that keeps the voltage of the individual electrode at the intermediate voltage Ve that is larger than zero voltage in the fixed period 171*a*. The intermediate voltage Vc is a value that is smaller than V0. In other words, in the additional signal 171, the piezoelectric changes in the period 171*a* are smaller than the piezoelectric changes in period Th in the ink discharge signal 155. Thus, in the additional signal 171, ink will rarely be discharged in the period 171*a*. Thus, the width of the period 171*a* may be set near the AL. In this case, the actuator 50 will repeat the deformation corresponding to the voltage applied.

In addition, the additional signals 170 or 171 will be set so that the difference in the electric potential between the individual electrode 35 and the common electrode 34 is smaller than V0, at least one time during the non-discharge period, In other words, the additional signals 170 or 171 will set the volume of the pressure chamber 10 to be larger than V1 at least one time during the non-discharge period. Thus, the additional signals 170 or 171 will independently exhibit this effect even if the additional signals 157 to 160 are not supplied. In other words, an effect can be obtained in which the changes in the characteristics of the piezoelectric film are reduced, even if the additional signals 170 or 171 are supplied instead of the additional signals 157-160.

<Periods In Which Additional Signals Are Applied>

As described above, during printing, the additional signal will be applied to the individual electrode 35 between one advanced ink discharge operation and one subsequent ink discharge operation. The period in which the additional signal will be applied is not limited to between the ink discharge operations during printing.

For example, even when the printing sheet P is not positioned below the nozzle 8, the additional signals will be applied. In this case, the controller 100 will apply the additional signal to the individual electrode 35 based upon the detection data transmitted from the paper sensor 133 to the controller 100. When this occurs, a non-discharge period can be specified relatively simply based upon the data from the paper sensor 133, and a more reliable additional signal can be supplied.

In addition, the additional signal will also be applied during a page feeding period and a line feeding period. In this case as well, a non-discharge period can be specified relatively simply, and the additional signal can be applied more reliably.

<Modifications>

Although preferred embodiments of the present invention were described above, the present invention is not limited to the embodiments described above, and various design modifications are possible within the scope of the claims.

For example, in the aforementioned embodiment, the actuator unit 21 is comprised by lamination of the piezoelectric films 41-44. In above embodiment, the piezoelectric films 42-44 serve as diaphragms. However, except for the piezoelectric films sandwiched between the two electrodes (the individual electrode 35 and the common electrode 34), a diaphragm plate formed from a metal material or the like other than a piezoelectric material may be used. In this case, changes will not occur in the characteristics of the non-active portion 53 of the piezoelectric film 42 in the aforementioned embodiment.

In the aforementioned embodiment, the piezoelectric film 41 extends so as to cover the plurality of pressure chambers 10. However, the piezoelectric film sandwiched by the two electrodes (the individual electrode 35 and the common electrode 34) may be arranged only in the area facing the pressure chambers 10. The actuator 50 that includes the piezoelectric film 41 may form at least a portion of the wall of the pressure chamber 10. In this type of situation as well, changes in the orientation distribution will occur in the non-active portions, i.e., the portions of the piezoelectric film not sandwiched by the two electrodes. Thus, in this situation as well, changes in the characteristics of the piezoelectric film can be prevented by supplying the aforementioned additional signals. In other words, an inkjet printer whose ink discharge characteristics will rarely change, even when used for a long period of time, can be provided because the controller 100 applies the additional signal that sets the volume of the pressure chamber 10 to be larger than V1 in at least a portion of the non-discharge period.

In the aforementioned embodiment, a situation was described in which microscopic structural changes (changes in the polarization structure) were caused in both the non-active portion 52 of the piezoelectric sheet 41 and the non-active portion 53 of the piezoelectric sheet 42. However, for example, even in situations in which the piezoelectric sheet 41 does not have the non-active portion 52, i.e., does not have a portion not sandwiched by two electrodes, changes in the orientation distribution will be only cause in the non-active portion 53 of the piezoelectric sheet 42 (changes to the polarization structure). Thus, in this situation as well, changes in the piezoelectric characteristics of the piezoelectric film 42 can be reduced by applying the aforementioned additional signals. In other words, an inkjet printer whose ink discharge characteristics will rarely change, even when used for a long period of time can be obtained because the controller 100 applies the additional signal that sets the volume of the pressure chamber 10 to be larger than V1 in at least a portion of the non-discharge period.

In the aforementioned embodiment, the inkjet printer has a unimorph piezoelectric actuator. The present invention can be applied to an inkjet printer having piezoelectric actuators other than the unimorph type. Even with a piezoelectric actuator other than the unimorph type, in situations in which there are regions in the piezoelectric film in which piezoelectricity is not applied, changes in the characteristics of the piezoelectric film can be reduced by application of the aforementioned additional signals.

As shown in FIG. 10(*b*), the intervals Te and Tg before and after the additional signal 157 are preferably half or more of the respective printing interval T0. Thus, the inkjet printer may be designed so as to determine whether the non-discharge period is equal to or greater than the printing interval T0 or less than the printing interval T0, and supply the additional signal 157 only when equal to or greater than T0. In the alternative, the inkjet printer may use whether or not the non-discharge period is half or more the printing interval T0 as a reference to determine whether or not to supply the additional signal 157.

In the aforementioned embodiment, the inkjet printer has a line head type of inkjet head that is fixed to the printer body. However, the present invention can be applied to an inkjet printer having a serial type of inkjet head. In addition, the inkjet printer may also be of a type which moves the inkjet head in the conveying direction with respect to the printing sheet P.

What is claimed is:

1. An inkjet printer comprising:

an inkjet head having a piezoelectric actuator, a pressure chamber, and a nozzle; and a controller configured to apply a voltage to the piezoelectric actuator, wherein:

the piezoelectric actuator forms a portion of a wall defining the pressure chamber;

the piezoelectric actuator is configured to deform to project toward the pressure chamber and to change a volume of the pressure chamber while the controller applies the voltage to the piezoelectric actuator;

the controller is configured to apply a first ink discharge signal and a second ink discharge signal to the piezoelectric actuator, each of the first ink discharge signal and the second ink discharge signal comprising:

a first advanced voltage change from a first predetermined voltage to zero voltage to cause the volume of the pressure chamber to change from a first volume to a second volume which is greater than the first volume; and a first subsequent voltage change from zero voltage to the first predetermined voltage to cause the volume of the pressure chamber to change from the second volume to the first volume, the first subsequent voltage change being delayed for a predetermined period from the first advanced voltage change, wherein each of the first ink discharge signal and the second ink discharge signal causes an ink discharge operation from the nozzle; and the controller is further configured to apply an additional signal to the piezoelectric actuator between the first ink discharge signal and the second ink discharge signal, the additional signal comprising:

a second advanced voltage change from the first predetermined voltage to a second predetermined voltage less than the first predetermined voltage to cause the volume of the pressure chamber to change from the first volume to a third volume which is greater than the first volume; and a second subsequent voltage change from the second predetermined voltage to the first predetermined voltage to cause the volume of the pressure chamber to change from the third volume to the first volume, wherein the additional signal does not cause the ink discharge operation from the nozzle.

2. The ink jet printer of claim 1, wherein when the inkjet head does not face a recording medium during an interval from an end timing of the first ink discharge signal to a beginning timing of the second ink discharge signal, the controller is further configured to apply the additional signal.

3. The ink jet printer of claim 1, wherein when a feeding operation is performed during an interval from an end timing of the first ink discharge signal to a beginning timing of the second ink discharge signal, the controller is further configured to apply the additional signal.

4. The inkjet printer of claim 1, wherein the second predetermined voltage is zero volts.

5. The ink jet printer of claim 1, wherein the piezoelectric actuator comprises:

a diaphragm sealing the pressure chamber;

a piezoelectric film stacked on the diaphragm at a side opposite to the pressure chamber; and electrodes provided at both surfaces of the piezoelectric film.

6. The ink jet printer of claim 5, wherein the piezoelectric film extends continuously over the pressure chamber.

7. The ink jet printer of claim 5, wherein the diaphragm comprises a piezoelectric material.

8. The ink jet printer of claim 7, wherein the diaphragm extends continuously over the pressure chamber.

9. The inkjet printer of claim 1, wherein the controller maintains voltage at the first predetermined voltage during each of a first interval from an end timing of the first ink discharge signal to a beginning timing of the additional signal, and a second interval from an end timing of the additional signal to a beginning timing of the second ink discharge signal.

10. The ink jet printer of claim 9, wherein a third interval from the beginning timing of the additional signal to the end timing of the additional signal is different than a period of each of the first ink discharge signal and the second ink discharge signal.

11. The ink jet printer of claim 9, wherein the controller is further configured to apply the second predetermined voltage to the piezoelectric actuator during a third interval from the beginning timing of the additional signal to an intermediate timing of the additional signal between the beginning timing of the additional signal and the end timing of the additional signal, and to monotonically increase voltage from the second predetermined voltage to the first predetermined voltage during a fourth interval from the intermediate timing of the additional signal to the end timing of the additional signal.

12. The ink jet printer of claim 9, wherein the controller is further configured to apply the second predetermined voltage to the piezoelectric actuator during a third interval from the beginning timing of the additional signal to an intermediate timing of the additional signal between the beginning timing of the additional signal and the end timing of the additional signal, and to stepwise increase voltage from the second predetermined voltage to the first predetermined voltage during a fourth interval from the intermediate timing of the additional signal to the end timing of the additional signal.

13. The ink jet printer of claim 9, wherein the second interval is greater than or equal to one half of a printing interval T0, which is a period from a beginning timing of the first ink discharge signal for printing a first dot to the beginning timing of the second ink discharge signal for printing a second dot separated from the first dot by a printing resolution.

14. The ink jet printer of claim 9, wherein the first interval is greater than or equal to one half of a printing interval T0, which is a period from a beginning timing of the first ink discharge signal for printing a first dot to the beginning timing of the second ink discharge signal for printing a second dot separated from the first dot by a printing resolution.

15. The ink jet printer of claim 9, wherein an amount of time that the voltage applied to the piezoelectric actuator is maintained at the first predetermined voltage during a printing interval T0, which is a period from a beginning timing of the first ink discharge signal for printing a first dot to the beginning timing of the second ink discharge signal for printing a second dot separated from the first dot by a printing resolution, is less than or equal to one half of the printing interval T0.

16. The ink jet printer claim 15, wherein a period that the voltage applied to the piezoelectric actuator is maintained at the second predetermined voltage during the printing interval T0 is different than a period of each of the first ink discharge signal and the second ink discharge signal.

17. An inkjet printer comprising:

an inkjet head having a piezoelectric actuator and a pressure chamber; and a controller configured to apply energy to the piezoelectric actuator; wherein:

the piezoelectric actuator forms a portion of a wall defining the pressure chamber;

the piezoelectric actuator is configured to deform to project toward the pressure chamber and to decrease a volume of the pressure chamber while the controller applies the energy to the piezoelectric actuator;

the controller is configured to apply an ink discharge signal to the piezoelectric actuator, the ink discharge signal comprising:

a first advanced change from a first predetermined energy level to zero energy level; and a first subsequent change from zero energy level to the first predetermined energy level, the first subsequent change being delayed for a predetermined period from the first advanced change, wherein the ink discharge signal causes an ink discharge operation from the nozzle; and the controller is further configured to apply an additional signal to the piezoelectric actuator, the additional signal comprising:

a second advanced change from the first predetermined energy level to a second predetermined energy level; and a second subsequent change from the second predetermined energy level to the first predetermined energy level, wherein the second energy level is greater than zero energy level and less than the first predetermined energy level, and the additional signal does not cause the ink discharge operation.

* * * * *